US008720565B2

(12) United States Patent
Springett et al.

(10) Patent No.: US 8,720,565 B2
(45) **Date of Patent: *May 13, 2014**

(54) TUBULAR SEVERING SYSTEM AND METHOD OF USING SAME

(75) Inventors: Frank Benjamin Springett, Spring, TX (US); Christopher Dale Johnson, Cypress, TX (US); Shern Eugene Peters, Houston, TX (US); Eric Trevor Ensley, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 183 days.

This patent is subject to a terminal disclaimer.

(21) Appl. No.: 13/118,289

(22) Filed: May 27, 2011

(65) Prior Publication Data

US 2011/0226477 A1 Sep. 22, 2011

Related U.S. Application Data

(60) Continuation-in-part of application No. 12/883,469, filed on Sep. 16, 2010, now Pat. No. 8,066,070, which is a continuation of application No. 12/151,279, filed on May 5, 2008, now Pat. No. 7,814,979, which is a division of application No. 11/411,203, filed on Apr. 25, 2006, now Pat. No. 7,367,396.

(60) Provisional application No. 61/349,660, filed on May 28, 2010, provisional application No. 61/349,604, filed on May 28, 2010, provisional application No. 61/359,746, filed on Jun. 29, 2010, provisional application No. 61/373,734, filed on Aug. 13, 2010.

(51) Int. Cl.
*E21B 29/00* (2006.01)
*E21B 33/06* (2006.01)

(52) U.S. Cl.
USPC ..... 166/297; 166/298; 166/363; 166/364; 166/85.4

(58) Field of Classification Search
USPC ..... 166/297, 298, 55, 85.4, 361, 363; 251/1.1
See application file for complete search history.

(56) References Cited

U.S. PATENT DOCUMENTS 1,161,705 A 11/1915 Lloyd et al.
2,178,698 A 11/1939 Penick et al.

(Continued)

FOREIGN PATENT DOCUMENTS

CA 2649771 12/2006
DE 3516424 A1 11/1986

(Continued)

OTHER PUBLICATIONS

West Engineering Services. Shear Ram Capabilities Study. Sep. 2004, pp. 2-2 and 3-6.*

(Continued)

*Primary Examiner* — James Sayre
(74) *Attorney, Agent, or Firm* — The JL Salazar Law Firm

(57) ABSTRACT

A method for severing a tubular of a wellbore is provided. The method involves positioning a blowout preventer about a tubular, the blowout preventer having a plurality of rams slidably positionable therein and a plurality of blades carried by the rams for engaging the tubular. The method further involves piercing the tubular with a piercing point of at least one of the blades such that a portion of the tubular is dislodged therefrom, and raking through the tubular with a cutting surface of at least one of the blades.

25 Claims, 33 Drawing Sheets

(56) References Cited

U.S. PATENT DOCUMENTS 2,231,613 A * 2/1941 Burke ..... 251/1.3
2,304,793 A * 12/1942 Bodine, Jr.
2,555,069 A 5/1951 Verney
2,592,197 A 4/1952 Schweitzer
2,596,851 A 5/1952 Hansen
2,752,119 A 6/1956 Allen et al.
2,919,111 A * 12/1959 Nicolson ..... 166/352
3,040,611 A * 6/1962 Tournaire ..... 83/636
3,145,462 A 8/1964 Bognar
3,272,222 A 9/1966 Allen et al.
3,399,728 A * 9/1968 Taylor ..... 166/53
3,554,278 A 1/1971 Reistle, III et al. ..... 166/85
3,554,480 A * 1/1971 Rowe ..... 251/1.3
3,561,526 A * 2/1971 Williams et al. ..... 166/55
3,647,174 A 3/1972 LeRouax ..... 251/1
3,670,761 A 6/1972 Lerouax ..... 137/315
3,716,068 A * 2/1973 Addison ..... 137/67
3,741,296 A 6/1973 Murman et al.
3,744,749 A 7/1973 LeRouax
3,766,979 A 10/1973 Petrick ..... 166/55
3,817,326 A 6/1974 Meynier, Iii
3,863,667 A * 2/1975 Ward ..... 137/318
3,918,478 A 11/1975 Le Rouax ..... 137/315
3,922,780 A * 12/1975 Green ..... 30/92
3,946,806 A 3/1976 Meynier, III
3,955,622 A 5/1976 Jones ..... 166/0.5
4,007,797 A 2/1977 Jeter
4,015,496 A 4/1977 Hill
4,043,389 A 8/1977 Cobb ..... 166/55
4,057,887 A 11/1977 Jones et al.
4,119,115 A * 10/1978 Carruthers
4,132,265 A 1/1979 Williams, Jr. ..... 166/55
4,132,267 A * 1/1979 Jones ..... 166/55
4,140,041 A * 2/1979 Frelau ..... 89/1.14
4,215,749 A 8/1980 Dare et al. ..... 166/361
4,220,206 A 9/1980 Van Winkle
4,240,503 A * 12/1980 Holt et al. ..... 166/55
4,253,638 A 3/1981 Troxell, Jr. ..... 251/1 A
4,313,496 A * 2/1982 Childs et al. ..... 166/55
4,341,264 A 7/1982 Cox et al. ..... 166/55
4,347,898 A 9/1982 Jones
4,372,527 A 2/1983 Rosenhauch et al. ..... 251/1 A
4,392,633 A 7/1983 Van Winkle
4,416,441 A 11/1983 Van Winkle
4,437,643 A 3/1984 Brakhage, Jr. et al. ..... 251/1 A
4,492,359 A 1/1985 Baugh
4,504,037 A 3/1985 Beam et al. ..... 251/1
4,508,313 A * 4/1985 Jones ..... 251/1.3
4,516,598 A 5/1985 Stupak ..... 137/318
4,518,144 A 5/1985 Vicic et al. ..... 251/1 A
4,519,577 A * 5/1985 Jones ..... 251/62
4,523,639 A * 6/1985 Howard, Jr. ..... 166/55
4,526,339 A * 7/1985 Miller ..... 251/1.3
4,537,250 A * 8/1985 Troxell, Jr. ..... 166/55
4,540,046 A * 9/1985 Granger et al. ..... 166/55
4,549,349 A 10/1985 Harrison
4,550,895 A 11/1985 Shaffer ..... 251/1.3
4,558,842 A 12/1985 Peil et al. ..... 251/1.3
4,612,983 A 9/1986 Karr, Jr.
4,646,825 A * 3/1987 Van Winkle ..... 166/55
4,647,002 A 3/1987 Crutchfield
4,690,033 A 9/1987 Van Winkle
4,690,411 A 9/1987 Van Winkle
4,699,350 A 10/1987 Herve ..... 25/1.3
4,923,005 A 5/1990 Laky et al. ..... 166/55
4,923,008 A * 5/1990 Wachowicz et al. ..... 166/373
4,943,031 A 7/1990 Van Winkle
4,969,390 A 11/1990 Williams, III ..... 92/28
4,987,956 A 1/1991 Hansen et al.
5,002,130 A * 3/1991 Laky ..... 166/351
5,013,005 A * 5/1991 Nance ..... 251/1.3
5,025,708 A 6/1991 Smith et al.
5,056,418 A 10/1991 Granger et al.
5,178,215 A 1/1993 Yenulis et al.
5,199,493 A * 4/1993 Sodder, Jr. ..... 166/297
5,217,073 A * 6/1993 Bruns ..... 166/298
5,237,899 A * 8/1993 Schartinger ..... 83/454
5,360,061 A * 11/1994 Womble ..... 166/55
5,361,832 A 11/1994 Van Winkle
5,400,857 A * 3/1995 Whitby et al. ..... 166/297
5,505,426 A 4/1996 Whitby et al. ..... 251/1.3
5,515,916 A 5/1996 Haley ..... 166/55
5,566,753 A 10/1996 Van Winkle et al.
5,575,451 A 11/1996 Colvin et al. ..... 251/1.3
5,575,452 A 11/1996 Whitby et al.
5,588,491 A * 12/1996 Brugman et al. ..... 166/383
5,590,867 A 1/1997 Van Winkle
5,655,745 A 8/1997 Morrill
5,662,171 A * 9/1997 Brugman et al. ..... 166/383
5,713,581 A 2/1998 Carlson et al.
5,735,502 A 4/1998 Levett et al.
5,778,918 A 7/1998 McLelland
5,833,208 A 11/1998 Lee, Jr.
5,863,022 A 1/1999 Van Winkle
5,897,094 A 4/1999 Brugman et al.
5,918,851 A 7/1999 Whitby
5,961,094 A 10/1999 Van Winkle
5,975,484 A 11/1999 Brugman et al.
6,006,647 A 12/1999 Van Winkle
6,012,528 A 1/2000 Van Winkle
6,016,880 A 1/2000 Hall et al.
6,113,061 A 9/2000 Van Winkle
6,158,505 A 12/2000 Araujo ..... 166/55
6,164,619 A 12/2000 Van Winkle et al.
6,173,770 B1 * 1/2001 Morrill ..... 166/85.4
6,192,680 B1 2/2001 Brugman et al.
6,244,336 B1 * 6/2001 Kachich ..... 166/55
6,244,560 B1 6/2001 Johnson
6,276,450 B1 8/2001 Seneviratne
6,374,925 B1 4/2002 Elkins et al.
6,484,808 B2 11/2002 Jones et al.
6,510,897 B2 1/2003 Hemphill ..... 166/373
6,530,432 B2 * 3/2003 Gipson ..... 166/384
6,601,650 B2 8/2003 Sundararajan
6,718,860 B2 4/2004 Mitsukawa et al.
6,719,042 B2 * 4/2004 Johnson et al. ..... 166/55
6,742,597 B2 6/2004 Van Winkle et al.
6,834,721 B2 12/2004 Suro ..... 166/297
6,843,463 B1 1/2005 McWhorter et al. ..... 251/1.1
6,857,634 B2 2/2005 Araujo
6,964,303 B2 11/2005 Mazorow et al.
6,969,042 B2 11/2005 Gaydos ..... 251/1.3
6,974,135 B2 12/2005 Melancon et al.
7,011,159 B2 3/2006 Holland
7,011,160 B2 * 3/2006 Boyd ..... 166/379
7,044,430 B2 5/2006 Brugman et al. ..... 251/1.1
7,051,989 B2 5/2006 Springett et al.
7,051,990 B2 5/2006 Springett et al. ..... 251/1.1
7,055,594 B1 6/2006 Springett et al.
7,086,467 B2 * 8/2006 Schlegelmilch et al. ..... 166/298
7,108,081 B2 9/2006 Boyadjieff
7,165,619 B2 1/2007 Fox et al.
7,195,224 B2 3/2007 Le
7,207,382 B2 * 4/2007 Schaeper ..... 166/55
7,225,873 B2 * 6/2007 Schlegelmilch et al. ..... 166/298
7,234,530 B2 * 6/2007 Gass ..... 166/376
7,243,713 B2 7/2007 Isaacks et al.
7,270,190 B2 9/2007 McWhorter et al.
7,287,544 B2 10/2007 Seneviratne et al.
7,331,562 B2 * 2/2008 Springett ..... 251/1.3
7,350,587 B2 4/2008 Springett et al.
7,354,026 B2 4/2008 Urrutia ..... 251/1.3
7,360,603 B2 4/2008 Springett et al.
7,367,396 B2 * 5/2008 Springett et al. ..... 166/298
7,389,817 B2 * 6/2008 Almdahl et al. ..... 166/361
7,410,003 B2 8/2008 Ravensbergen et al. ..... 166/384
7,434,369 B2 10/2008 Uneyama et al.
7,464,765 B2 12/2008 Isaacks et al.
7,487,848 B2 2/2009 Wells et al.
7,520,129 B2 4/2009 Springett
7,523,644 B2 4/2009 Van Winkle
7,673,674 B2 * 3/2010 Lam ..... 166/75.11
7,703,739 B2 * 4/2010 Judge et al. ..... 251/1.3
7,726,418 B2 6/2010 Ayling

(56) References Cited

U.S. PATENT DOCUMENTS

| | | | | |
|---|---|---|---|---|
| 7,748,473 | B2 | 7/2010 | Wells et al. | |
| 7,798,466 | B2 | 9/2010 | Springett et al. | |
| 7,814,979 | B2 * | 10/2010 | Springett et al. | 166/298 |
| 8,066,070 | B2 * | 11/2011 | Springett et al. | 166/298 |
| 2003/0127231 | A1 | 7/2003 | Schlegelmilch et al. | |
| 2004/0003919 | A1 | 1/2004 | Johnson et al. | |
| 2004/0124380 | A1 | 7/2004 | Van Winkle | |
| 2006/0076526 | A1 | 4/2006 | McWhorter et al. | |
| 2006/0113501 | A1 * | 6/2006 | Isaacks et al. | 251/1.1 |
| 2006/0137827 | A1 * | 6/2006 | Uneyama et al. | |
| 2007/0102655 | A1 * | 5/2007 | Springett | 251/1.3 |
| 2007/0137866 | A1 * | 6/2007 | Ravensbergen et al. | |
| 2007/0246215 | A1 | 10/2007 | Springett et al. | |
| 2008/0040070 | A1 | 2/2008 | McClanahan | |
| 2008/0185046 | A1 | 8/2008 | Springett et al. | |
| 2008/0189954 | A1 * | 8/2008 | Lin | 30/92 |
| 2008/0265188 | A1 | 10/2008 | Springett et al. | |
| 2008/0267786 | A1 | 10/2008 | Springett et al. | |
| 2008/0286534 | A1 * | 11/2008 | Springett et al. | 428/192 |
| 2009/0056132 | A1 | 3/2009 | Foote | |
| 2009/0205838 | A1 | 8/2009 | Springett | |
| 2010/0038088 | A1 | 2/2010 | Springett et al. | |
| 2012/0193087 | A1 | 8/2012 | Hall et al. | |
| 2012/0193556 | A1 | 8/2012 | Yadav et al. | |

FOREIGN PATENT DOCUMENTS

| | | | |
|---|---|---|---|
| EP | 0145456 | | 6/1985 |
| EP | 0145456 | A2 | 6/1985 |
| EP | 0 593 280 | | 4/1994 |
| EP | 2013443 | B1 | 6/2011 |
| GB | 2100773 | A | 6/1983 |
| JP | S53-015683 | A | 2/1978 |
| RU | 2401935 | C2 | 5/2010 |
| SU | 959935 | A | 9/1982 |
| WO | 99/049179 | | 9/1999 |
| WO | 9949179 | | 9/1999 |
| WO | 03/060288 | A1 | 7/2003 |
| WO | 03060288 | | 7/2003 |
| WO | 2005/106187 | A1 | 11/2005 |
| WO | 2006014895 | A2 | 2/2006 |
| WO | 2007/122365 | A1 | 11/2007 |

OTHER PUBLICATIONS

EPO, Office Action dated Dec. 6, 2011 for related European Application No. 11180788.9.
International Search Report and Written Opinion dated Nov. 30, 2011 for related PCT Application No. PCT/GB2011/051004.
International Search Report and Written Opinion dated Nov. 28, 2011 for related PCT Application No. PCT/GB2011/051005.
International Search Report and Written Opinion dated Nov. 28, 2011 for related PCT Application No. PCT/GB2011/051006.
National Oilwell Vargo, "Nationai Oliwell Varco Makes Spotlight Award List", Offshore Magazine., Apr. 2011, pp. 1.
National Oilwell Varco, OTC 2011: ShearMax Low Force Casing Shear Rams, p. 1.
Ben Casselman and Russell Gold, "Device's Design Flaw Let Oil Spill Freely", Business, Mar. 24, 2011, pp. 1-4.
Diane Langlely. "Drilling Contractor", Categorized, Jan. 28, 2011, p. 5.
Neil Lukosavich, "OTC 2011 Shifts Gears to Navigate. Post-Macondo Landscape", World Oil, vol. 232 No. 4, pp. 1-8.
Frank Springett et al, "Low Force Shear Rams: The Future is More", SPE/IADC 140365, Mar. 1-3, 2011. pp. 1-9.
CIPO, Canadian Patent Application No. 2,649,771, Examination Report and Response, May 28, 2010, pp. 1-17.
EPO, European Patent Application No. 06820703.4-2315, First Examination Report and Response, Sep. 11, 2009, 47 pgs.
EPO, European Patent Application No. 06820703.4-2315, Notice of Allowance and Post Allowance Amendment. Aug. 3, 2010, 39 pgs.
EPO, European Patent Application No. 06820703.4-2315, Post Allowance Amendment including French and German language translations of amended claims, Dec. 13, 2010, 49 pgs.
EPO, European Divisional Patent Application No. 11168306.6-2315, Extended European Search Report, Aug. 4, 2011, pp. 1-6.
RU, Russian Patent Application No. 2008146406, Russian Amended Claim Set and Decision on Grant, May 12, 2010, 17 pgs.
EPO, PCT Patent Application No. PCT/GB2006/050478, International Search Report and Written Opinion, Apr. 4, 2007, 11 pgs.
EPO PCT Patent Application No. PCT/GB2006/050478, Demand, Written Opinion Response and Amended Claims, Feb. 25, 2008, 32 pgs.
EPO, PCT Patent Application No. PCT/GB2006/050478, International Preliminary Report on Patentability, Aug. 12, 2008, 8 pgs.
Shear Ram Capabilities Study: West Engineering Services; pages Cover to 4-7 (23 pages); Sep. 2004.
Land & Marine Drilling: Cameron Iron Works Oil Tool Division; pages Cover, 1604, 1617, 1621: 1982-1983.
Varco's NXT Next Generation BOP Systems reduce the cost of Drilling; Varco; 6 pages: 2001.
Examination Report (Communication pursuant to Article 94(3) EPC) from counterpart EP Application No. 11 180 788.9 dated Nov. 2, 2012 (4 pages).
Response to Examination Report from counterpart EP Application No. 11 180 788.9 dated Mar. 8, 2013 (6 pages).
Chinese Office Action for counterpart Chinese Application No. 200680054363.7 dated Aug. 25, 2011, p. 1-9.
Response to Examination Report for counterpart Chinese Application No. 200680054363.7 dated Aug. 25, 2011, p. 1-9.
Chinese Office Action for counterpart Chinese Application No. 200680054363.7 dated Apr. 1, 2012, p. 1-16.
Response to Chinese Office Action for counterpart Chinese Application No. 20060054363.7 dated Apr. 1, 2012, p. 1-35.
EPO Extended Search Report for Application No. 11180788.9 dated Dec. 6, 2011, 8 pages.
EPO Extended Search Report for Application No. 11180811.9 dated May 30, 2012, 6 pages.
PCT Notification of Transmittal of International Search Report and the Written Opinion for Application No. PCT/GB2011/051006 dated Nov. 28, 2011, 12 pages.
PCT Notification of Transmittal of International Search Report and the Written Opinion for Application No. PCT/GB2011/051005 dated Nov. 28, 2011, 11 pages.
PCT Notification of Transmittal of International Search Report and the Written Opinion for Application No. PACT/GB2011/051004 dated Nov. 30, 2011, 12 pages.
PRC Office Action for Chinese Application No. 200680054363.7 dated Aug. 25, 2011, 5 pages.
PRC Office Action for Chinese Application No. 200680054363.7 dated Apr. 1, 2012, 4 pages.
Jun. 18, 2012 Response to Office Action for Chinese Application No. 200680054363.7 dated Apr. 1, 2012 (English Translation), 12 pages.
Response to Office Action for Chinese Application No. 200680054363.7 dated Aug. 25, 2011, 7 pages.
Notice of Allowance for CIPO, Canadian Application No. 2649771 dated Jan. 26, 2011, 1 page.
Notice of Allowance for CIPO, Canadian Application No. 2754716 dated Dec. 22, 2011, 6 pages.
Examination Report for CIPO, Canadian Application No. 2747138 dated Oct. 25, 2011, 2 pages.
Response to Examination Report for Canadian Application No. 2747138 dated Apr. 19, 2012, 9 pages.
Notice of Allowance for CIPO, Canadian Application No. 2747138 dated May 23, 2012, 1 page.

* cited by examiner

TUBULAR SEVERING SYSTEM AND METHOD OF USING SAME

CROSS-REFERENCE TO RELATED APPLICATIONS

This application is a continuation-in-part of U.S. Non-Provisional application Ser. No. 12/883,469 filed on Sep. 16, 2010, which is a continuation of U.S. Non-Provisional application Ser. No. 12/151,279 filed on May 5, 2008, which is now U.S. Pat. No. 7,814,979, which is a divisional of U.S. Non-Provisional application Ser. No. 11/411,203 filed on Apr. 25, 2006, which is now U.S. Pat. No. 7,367,396, the entire contents of which are hereby incorporated by reference. This application also claims the benefit of U.S. Provisional Application No. 61/349,660 on May 28, 2010, U.S. Provisional Application No. 61/349,604 filed on May 28, 2010, U.S. Provisional Application No. 61/359,746 filed on Jun. 29, 2010, and U.S. Provisional Application No. 61/373,734 filed on Aug. 13, 2010, the entire contents of which are hereby incorporated by reference.

BACKGROUND OF THE INVENTION

1. Field of the Invention

This present invention relates generally to techniques for performing wellsite operations. More specifically, the present invention relates to techniques for preventing blowouts, for example, involving severing a tubular at the wellsite.

2. Description of Related Art

Oilfield operations are typically performed to locate and gather valuable downhole fluids. Oil rigs are positioned at wellsites, and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Downhole tubular devices, such as pipes, certain downhole tools, casings, drill pipe, liner, coiled tubing, production tubing, wireline, slickline, or other tubular members positioned in the wellbore and associated components, such as drill collars, tool joints, drill bits, logging tools, packers, and the like, (referred to as 'tubulars' or 'tubular strings') may be positioned in the wellbore to enable the passage of subsurface fluids to the surface.

Leakage of subsurface fluids may pose a significant environmental threat if released from the wellbore. Equipment, such as blow out preventers (BOPs), are often positioned about the wellbore to form a seal about a tubular therein to prevent leakage of fluid as it is brought to the surface. Typical BOPs may have selectively actuatable rams or ram bonnets, such as pipe rams (to contact, engage, and encompass tubulars and/or tools to seal a wellbore) or shear rams (to contact and physically shear a tubular), that may be activated to sever and/or seal a tubular in a wellbore. Some examples of BOPs and/or ram blocks are provided in U.S. Pat./Application Nos. 4,647,002, 6,173,770, 5,025,708, 5,575,452, 5,655,745, 5,918,851, 4,550,895, 5,575,451, 3,554,278, 5,505,426, 5,013,005, 5,056,418, 7,051,989, 5,575,452, 2008/0265188, 5,735,502, 5,897,094, 7,234,530 and 2009/0056132. Additional examples of BOPs, shear rams, and/or blades for cutting tubulars are disclosed in U.S. Pat. Nos. 3,946,806, 4,043,389, 4,313,496, 4,132,267, 4,558,842, 4,969,390, 4,492,359, 4,504,037, 2,752,119, 3,272,222, 3,744,749, 4,253,638, 4,523,639, 5,025,708, 5,400,857, 4,313,496, 5,360,061, 4,923,005, 4,537,250, 5,515,916, 6,173,770, 3,863,667, 6,158,505, 4,057,887, 5,178,215, and 6,016,880.

Despite the development of techniques for addressing blowouts, there remains a need to provide advanced techniques for more effectively severing a tubular within a BOP. The invention herein is directed to fulfilling this need in the art.

SUMMARY OF THE INVENTION

In at least one aspect, the invention relates to a method for severing a tubular of a wellbore, the wellbore penetrating a subterranean formation. The method involves positioning a blowout preventer about a tubular. The blowout preventer has a plurality of rams slidably positionable therein and a plurality of blades carried by the rams for engaging the tubular. The method further involves piercing the tubular with a piercing point of at least one of the blades such that a portion of the tubular is dislodged therefrom, and raking through the tubular with a cutting surface of at least one of the blades.

The method may also further involve continuing to advance the rams until the tubular is severed. In the step of raking, the cutting surface may be advanced until the tubular shears apart. In the step of piercing, the piercing point may pierce a central engagement portion of the tubular, or a mid engagement portion of the tubular. In the step of raking, the cutting surface may pass through a mid engagement portion of the tubular and/or an outer engagement portion of the tubular. The blade may also be provided with a pair of shavers, and the method may involve passing at least one of the pair of shavers through at least a portion of the tubular. In the step of passing, the shavers may pass through an outer engagement portion of the tubular. The blades may include an upper blade and a lower blade, and the method may further involve passing the upper blade through the tubular above the lower blade.

In another aspect, the invention relates to a method for severing a tubular of a wellbore. The method involves positioning a blowout preventer about the tubular. The blowout preventer has a plurality of rams slidably positionable therein, each of the plurality of rams carrying a blade. Each of the blades has a blade body having a front face on a side thereof facing the tubular. The blade body has a cutting surface along at least a portion of the front face, and a piercing point along the front face. The piercing point has a tip extending a distance beyond the cutting surface. The method further involves piercing the tubular with the piercing point of the blade such that a portion of the tubular is dislodged therefrom, and raking through the tubular with the cutting surface of the blade.

In the step of raking, the cutting surface may be advanced until the cutting surface severs the tubular. In the step of raking, the cutting surface may be advanced until the tubular shears apart. In the step of piercing, the piercing point may pierce a central engagement portion of the tubular. In the step of raking, the cutting surface may pass through a mid engagement portion of the tubular. In the step of raking, the cutting surface may pass through an outer engagement portion of the tubular.

The blade body may also have a pair of shavers along the front face of the blade body, each of the pair of shavers on either side of the tip, and the method may also involve passing at least one of the pair of shavers through at least a portion of the tubular. In the step of passing, the at least one of the pair of shavers may pass through an outer engagement portion of the tubular.

Finally, in yet another aspect, the invention relates to a method for severing a tubular of a wellbore. The method involves positioning a blowout preventer about a tubular. The blowout preventer has a plurality of rams slidably positionable therein and a plurality of blades carried by the rams for engaging the tubular. The method further involves advancing the plurality of blades through the tubular by piercing the tubular with a piercing point of at least one of the blades such that a portion of the tubular is dislodged therefrom and raking through the tubular with a cutting surface of at least one of the blades until the tubular is severed.

The blades may also have a pair of shavers, and the step of advancing may also involve passing at least one of the pair of shavers through at least a portion of the tubular. The step of advancing may also involve advancing the plurality of blades through the tubular by piercing the tubular with the pair of shavers. The blades may include an upper blade and a lower blade, with the upper blade passing through the tubular a distance above the lower blade.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The Figures are not necessarily to scale and certain features, and certain views of the Figures may be shown exaggerated in scale or in schematic in the interest of clarity and conciseness.

DETAILED DESCRIPTION OF THE INVENTION

The description that follows includes exemplary apparatus, methods, techniques, and/or instruction sequences that embody techniques of the present inventive subject matter. However, it is understood that the described embodiments may be practiced without these specific details.

This application relates to a BOP and at least one blade used to sever a tubular at a wellsite. The tubular may be, for example, a tubular that is run through the BOP during wellsite operations. The severing operation may allow the tubular to be removed from the BOP and/or the wellhead. Severing the tubular may be performed, for example, in order to seal off a borehole in the event the borehole has experienced a leak, and/or a blow out.

The BOP is provided with various blade configurations for facilitating severance of the tubular. These blades may be configured with piercing points, cutting surfaces and/or shavers intended to reduce the force required to sever a tubular. The invention provides techniques for severing a variety of tubulars (or tubular strings), such as those having a diameter of up to about 8.5" (21.59 cm). Preferably, the BOP and blades provide one or more of the following, among others: efficient part (e.g., blade) replacement, reduced wear, less force required to sever tubular, automatic sealing of the BOP, efficient severing, incorporation into (or use with) existing equipment and less maintenance time for part replacement.

Figure 1:
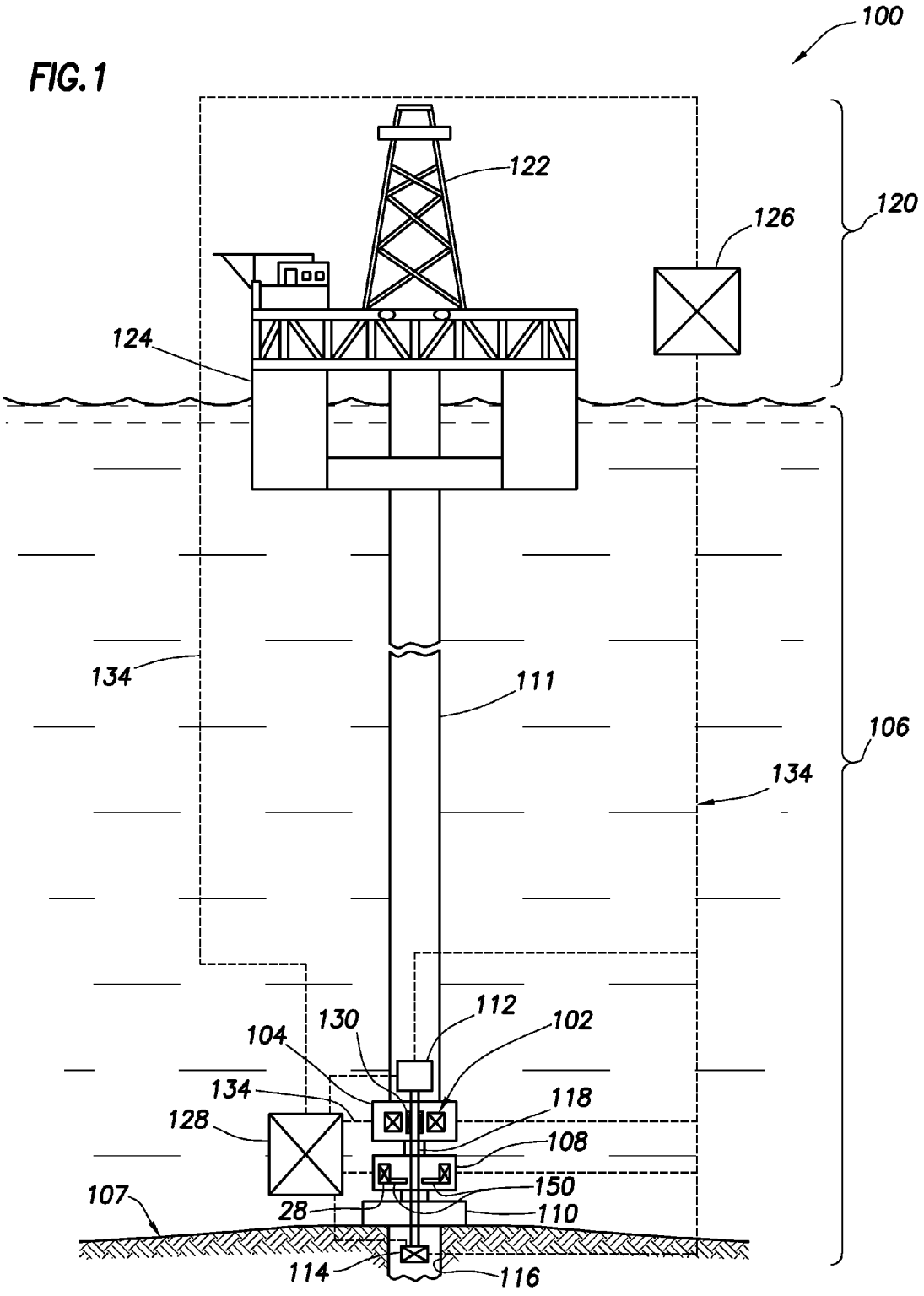
FIG. 1 shows a schematic view of an offshore wellsite having a blowout preventer (BOP) with blades for severing a tubular.

FIG. 1 depicts an offshore wellsite 100 having a subsea system 106 and a surface system 120. The subsea system 106 has a stripper 102, a BOP 108, a wellhead 110, and a tubing delivery system 112. The stripper 102 and/or the BOP 108 may be configured to seal a tubular 118 (and/or conveyance), and run into a wellbore 116 in the sea floor 107. The BOP 108 has at least one blade 150 for severing the tubular 118, a downhole tool 114, and/or a tool joint (or other tubular not shown). The BOP 108 may have one or more actuators 28 for moving the blade 150 and severing the tubular 118. One or more controllers 126 and/or 128 may operate, monitor and/or control the BOP 108, the stripper 102, the tubing delivery system 112 and/or other portions of the wellsite 100.

The tubing delivery system 112 may be configured to convey one or more downhole tools 114 into the wellbore 116 on the tubular 118. Although the BOP 108 is described as being used in subsea operations, it will be appreciated that the wellsite 100 may be land or water based and the BOP 108 may be used in any wellsite environment.

The surface system 120 may be used to facilitate the oilfield operations at the offshore wellsite 100. The surface system 120 may comprise a rig 122, a platform 124 (or vessel) and the controller 126. As shown the controller 126 is at a surface location and the subsea controller 128 is in a subsea location, it will be appreciated that the one or more controllers 126/128 may be located at various locations to control the surface 120 and/or the subsea systems 106. Communication links 134 may be provided by the controllers 126/128 for communication with various parts of the wellsite 100.

As shown, the tubing delivery system 112 is located within a conduit 111, although it should be appreciated that it may be located at any suitable location, such as at the sea surface, proximate the subsea equipment 106, without the conduit 111, within the rig 122, and the like. The tubing delivery system 112 may be any tubular delivery system such as a coiled tubing injector, a drilling rig having equipment such as a top drive, a Kelly, a hoist and the like (not shown). Further, the tubular string 118 to be severed may be any suitable tubular and/or tubular string as previously described. The downhole tools 114 may be any suitable downhole tools for drilling, completing, evaluating and/or producing the wellbore 116, such as drill bits, packers, testing equipment, perforating guns, and the like. Other devices may optionally be positioned about the wellsite for performing various functions, such as a packer system 104 hosting the stripper 102 and a sleeve 130.

Figure 2A:
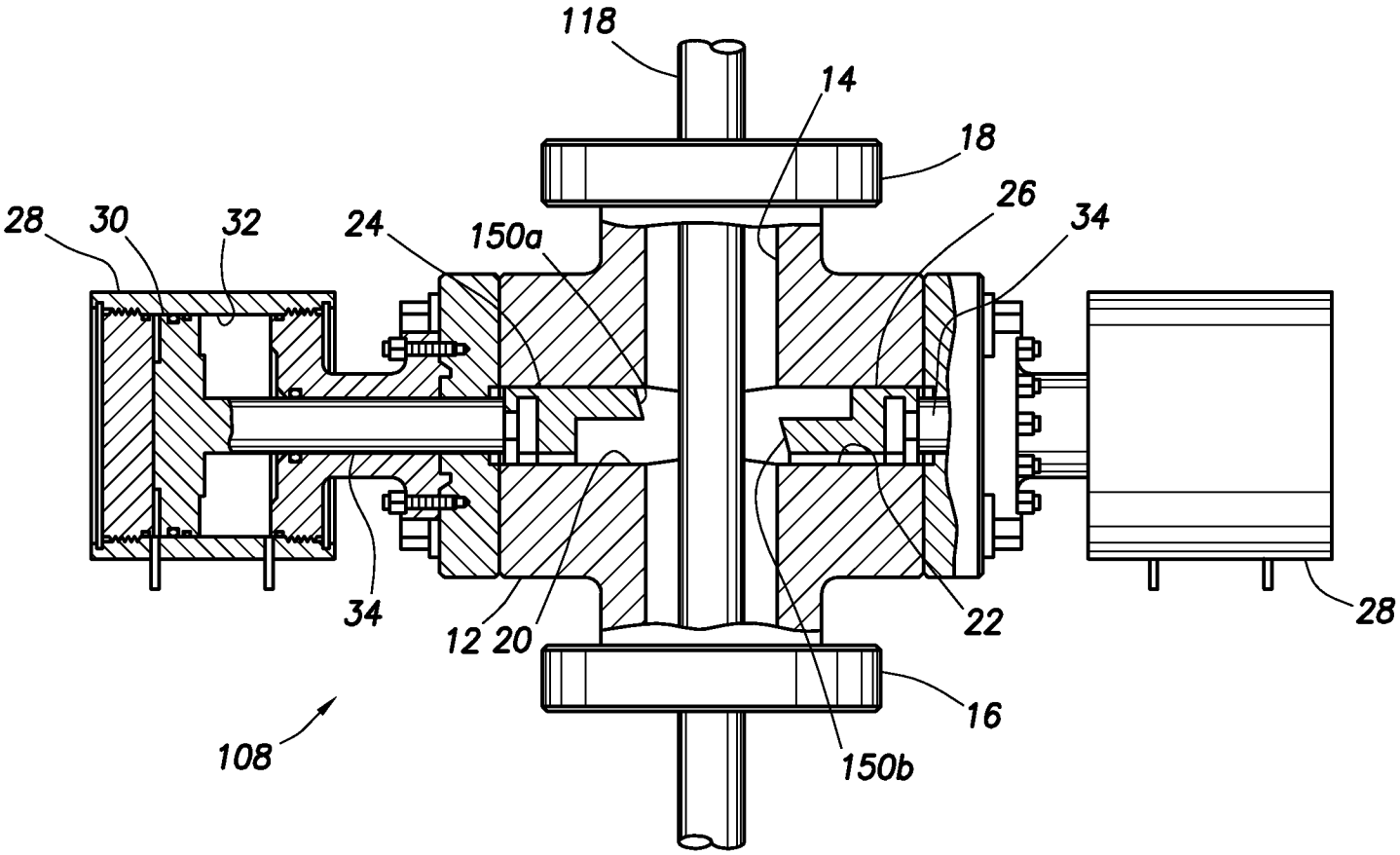
FIGS. 2A-2B show schematic side and top views, respectively, partially in cross-section, of the BOP of FIG. 1 prior to initiating a severing operation.
Figure 2B:
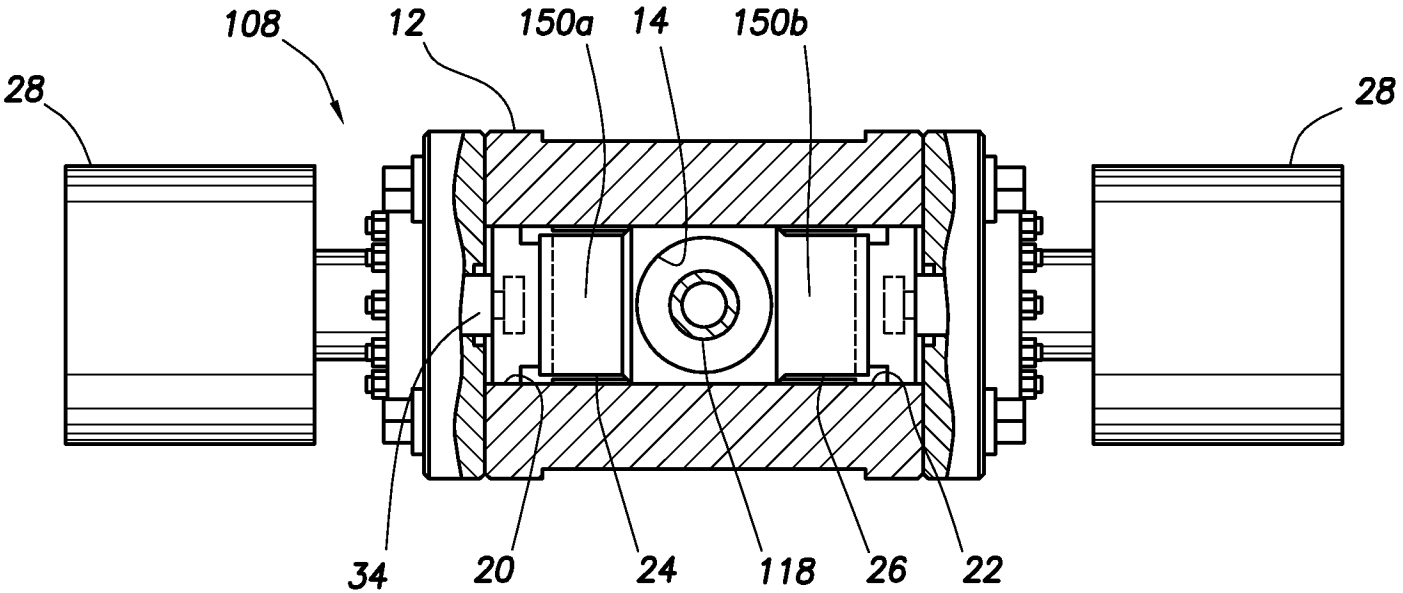
Figure 2C:
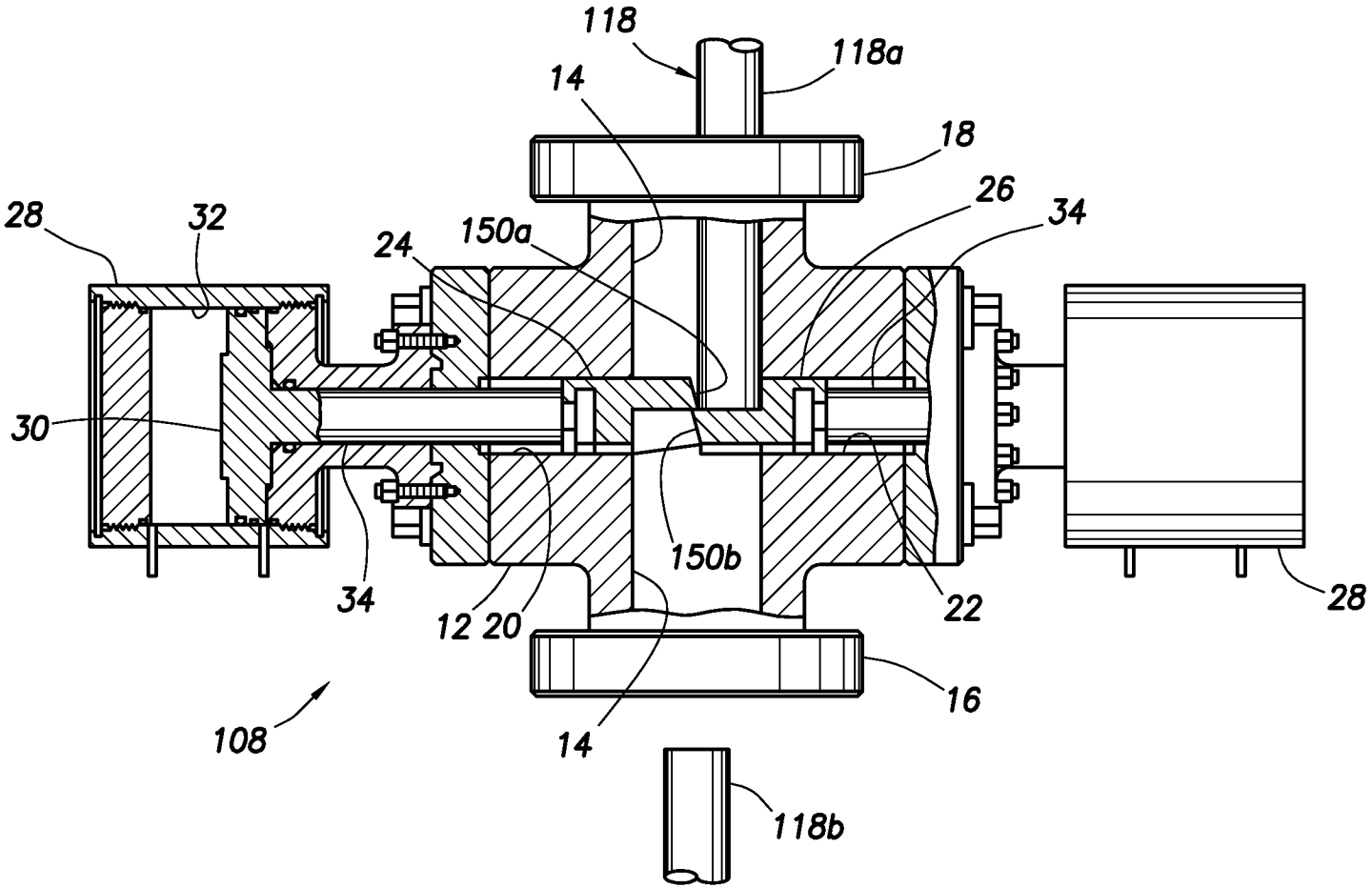
FIG. 2C is a schematic side view, partially in cross-section, of the BOP of FIG. 1 during a severing operation.

FIGS. 2A-2C depict the BOP 108 in greater detail. FIGS. 2A and 2B show the BOP 108 before actuation. FIG. 2C shows the BOP 108 after actuation. The BOP 108 may be similar to, for example, the BOP described in U.S. Non-Provisional application Ser. No. 12/883,469, previously incorporated herein. As shown in FIGS. 2A-2C, the BOP 108 may have a body 12 with a bore 14 extending therethrough. The tubular 118 may pass through the bore 14. The body 12 may have a lower flange 16 and an upper flange 18 for connecting the BOP 108 to other equipment in a wellhead stack, for example the stripper 102 (as shown in FIG. 1), the wellhead 110 and the like. The BOP 108 may have the one or more actuators 28 for actuating the one or more blades 150, such as a pair of blades 150*a,b*, in order to sever the tubular 118.

The actuators 28 may move a piston 30 within a cylinder 32 in order to move a rod 34. The rod 34 may couple to a blade holder 24 and 26, or first and second ram 24 and 26. Each of the blade holders 24 and 26 may couple to one of the blades 150*a,b*. Thus, the actuators 28 may move the blades toward and away from the bore 14 in order to sever the tubular 118 within the bore 14. The actuators 28 may actuate the blades 150*a,b* in response to direct control from the controllers 126 and/or 128, an operator, and/or a response to a condition in the wellbore 116 (as shown in FIG. 1) such as a pressure surge. As shown, the actuators 28 are hydraulically operated and may be driven by a hydraulic system (not shown), although any suitable means for actuating the blades 150*a,b* may be used such as pneumatic, electric, and the like.

One or more ram guideways 20 and 22, or guides, may guide each of the blades 150*a,b* within the BOP 108 as the actuator 28 moves the blades 150*a,b*. The ram guideways 20 and 22 may extend outwardly from opposite sides of the bore 14. FIG. 2B shows a top view of the BOP 108. The blade holders 24 and 26 are shown holding the blades 150*a,b* in an un-actuated position within the ram guideways 20 and 22.

The blades 150*a,b* of blade holders 24 and 26 may be positioned to pass one another within the bore 14 while severing the tubular 118. As shown, the pair of blades 150*a,b* includes an upper cutting blade 150*a* (any blade according to the present invention) on the ram 24 and a lower cutting blade 150*b* (any blade according to the present invention) on the ram 26. The cutting blades 150*a* and 150*b* may be positioned so that a cutting edge of the blade 150*b* passes some distance below the cutting edge of the blade 150*a* when severing and/or shearing a section of a tubular 118.

The severing action of cutting blades 150*a* and 150*b* may pierce, rake, shear, and/or cut the tubular 118 (see FIG. 2C) into upper portion 118*a* and lower portion 118*b*. After the tubular 118 is severed, the lower portion of the tubular 118*b* may drop into the wellbore 116 (as shown in FIG. 1) below the BOP 108. Optionally (as is true for any method according to the present invention) the drill string may be hung off a lower set of rams (not shown). The BOP 108 and/or another piece of equipment may then seal the borehole and/or the wellbore 116 in order to prevent an oil leak, and/or explosion.

Figure 3A:
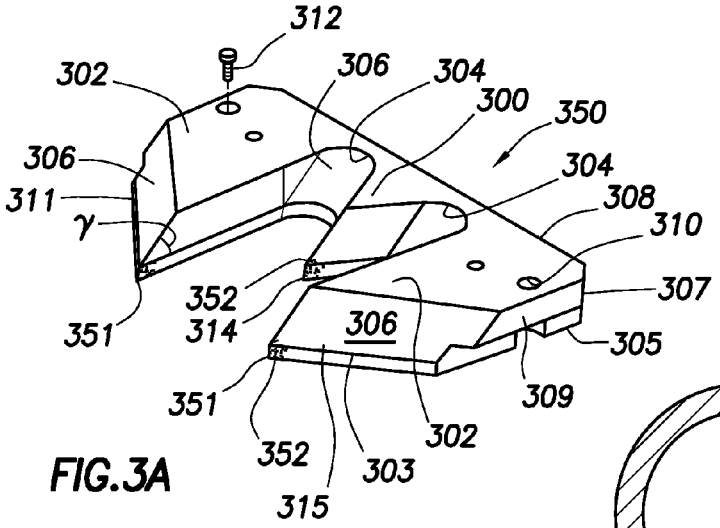
FIGS. 3A-3G are various schematic views of a blade usable in the BOP of FIG. 2A.

FIGS. 3A-8G shows various views of shapes that the blade 150 may take. FIGS. 3A-3G depict various views of a blade 350 usable, for example, as the blade 150 of FIG. 1-2C (and/or the upper blade 150*a* and/or the lower blade 150*b*). FIG. 3A is an exploded perspective view of the blade 350. FIG. 3B shows a bottom view of the blade 350 and a cross-sectional view of the tubular 118. FIG. 3C shows a top view of the blade 350. FIG. 3D shows a perspective rear view of the blade 350. FIG. 3E shows a side view of the blade 350. FIG. 3F shows a front view of the blade 350. FIG. 3G shows a cross-sectional view of the blade 350 taken along line 3G-3G of FIG. 3F.

The blade 350 is preferably configured to pierce, rake, shear and/or shave the tubular 118 as the blade 350 travels through a tubular, such as the tubular 118 of FIG. 1. The blade 350 as shown is provided with a blade body 307, a piercing point (or projection) 300, one or more shave points (or shavers) 302, one or more blade cutting surfaces 306, one or more troughs (or recesses) 304, a loading surface 308, and one or more apertures 310. The piercing point 300 and shavers 302 may extend from a front face 303 of the blade body 307. The front face 303 has a first portion 311 and a second portion 315 having the cutting surface thereon 306. The piercing point 300 is positioned between the first and second portions 311, 315. The blade body 307 may have a base 305 along a bottom thereof.

The apertures 310 may be configured for receipt of one or more connectors 312 for connecting the blade 350 to the blade holders 24 and 26 (as shown in FIG. 2A). The one or more connectors 312 may be used to secure the blades 350 to the blade holders 24 and 26. The connectors 312 may be any suitable connector such as a bolt, a pin, a screw, a weld and the like. The blade 350 may also be provided with, for example, shoulders 309 extending laterally for support, for example, in the guideways 20, 22 of the BOP 108 of FIGS. 2A-2C.

The piercing point 300 may be configured to substantially engage the tubular 118, preferably near the center (or a central portion) thereof. As the piercing point 300 engages the tubular 118, a tip (or apex) 314 of the piercing point 300 pierces and/or punctures the tubular 118. The piercing point 300 terminates at the tip 314, which may have a variety of shapes, such as rounded, pointed, an edge, etc., as described herein. As the piercing point 300 continues to move through the tubular 118, the blade cutting surfaces 306 on either side of the piercing point 300 may cut through the tubular 118 from the initial puncture point. The blade cutting surfaces 306 may also assist in centering the tubular 118 therebetween. Centering the tubular 118 may facilitate positioning the tubular 118 for optimized piercing and/or cutting.

Figure 3B:
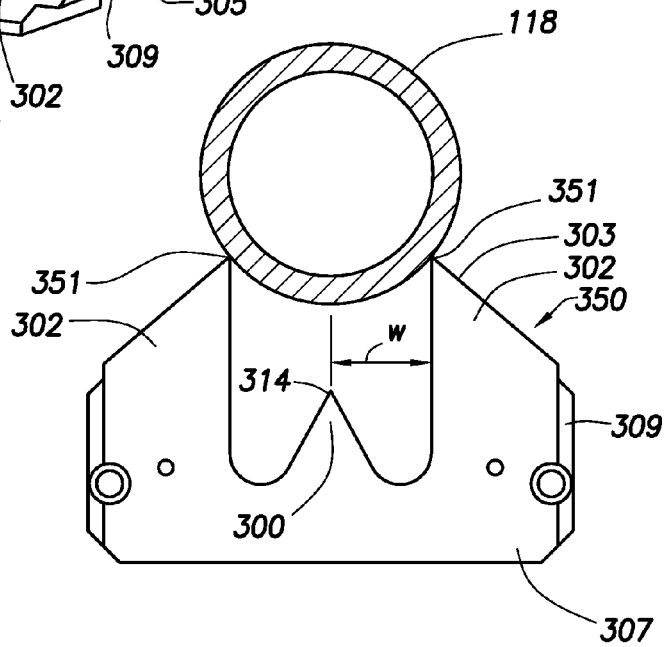

The one or more shavers 302 may be configured to engage the tubular 118 at a location toward an outer portion and/or away from a center (or a central portion) of the tubular 118 as shown in FIG. 3B. As shown, the one or more shavers 302 are configured to engage the tubular 118 near an edge (or outer portion) of the tubular 118. The one or more shavers 302 may have projections 351 to puncture the tubular 118 in a similar manner as the piercing point 300. A width W (FIG. 3B) between the tip 314 of the piercing point 300 and the projection 351 of the shavers 302 may be configured for contact with a desired portion of the tubular 118.

Figure 3C:
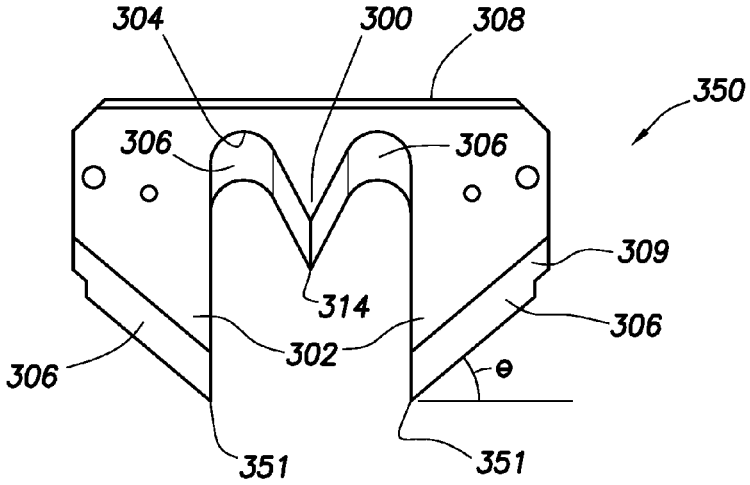
Figure 3D:
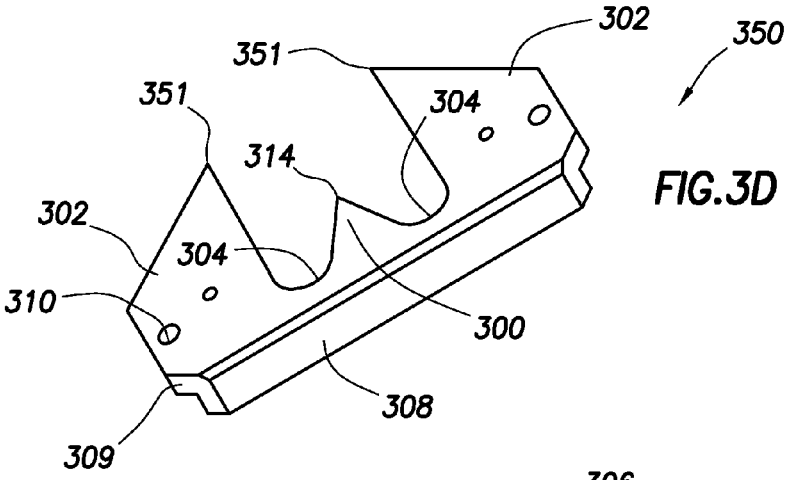
Figure 3E:
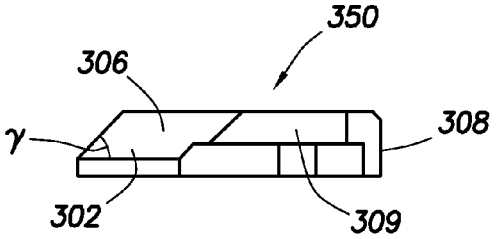
Figure 3F:
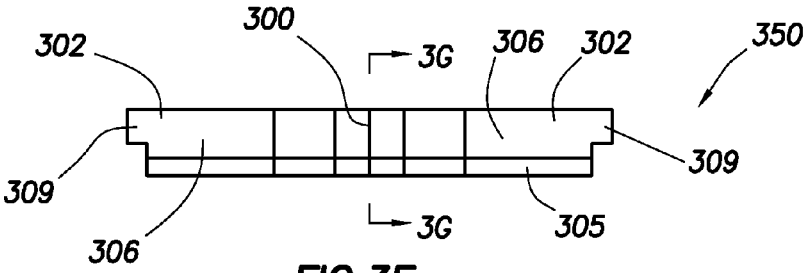
Figure 3G:
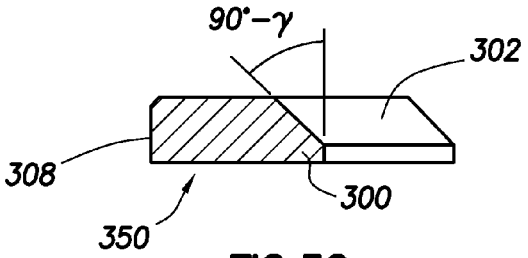

As the blade 350 continues to move through the tubular 118, the shavers 302 may pass through the tubular. The blade cutting surface 306 on the shavers 302 may have a cutting (or incline) angle $\gamma$ for passing through the tubular 118. The cutting angle $\gamma$ of the blade cutting surface 306 may vary at locations about the blade 350 as needed to facilitate the severing process. The cutting angle $\gamma$ is shown, for example, in FIG. 3E with a complement angle of 90 degrees $-\gamma$ shown in FIG. 3G. The shavers 302 may also have an exit angle $\theta$ on an outer surface, as shown in FIG. 3C, that may continue to cut the walls of the tubular 118. The exit angle θ may be configured to pull apart the wall of the tubular 118 as the blade cutting surface 306 cuts the wall thereby reducing the force required to sever the tubular.

The one or more shavers 302 may be configured to shave, and/or shear, away a portion of the tubular 118 on both sides of the piercing point 300 thereby decreasing the strength and integrity of the tubular 118. The one or more shavers 302 may centrally align the tubular 118 relative to the blade 350 as the blade 350 engages the tubular 118. As shown in FIGS. 3A-3C, the one or more shavers 302 may engage the tubular 118 prior to the piercing point 300 engaging the tubular 118. By adjusting the configuration such that the piercing point 300 and/or shaving points 302 may be at various lengths relative to each other, the shavers 302 may be configured to engage the tubular 118 substantially simultaneously with the piercing point 300 and/or after the piercing point 300. In this manner, the blade 350 may pierce and/or shave the tubular 118 at one or more locations to facilitate severance thereof.

The geometry of the blades described herein may be adjusted to provide contact points at various locations along the blade. By manipulating the dimensions and position of the piercing point 300, the shavers 302 and the front face 303, the contact of the blade with the tubular may be adjusted and/or optimized. While FIGS. 3A-3G depict a specific configuration of the shavers 302 for contact with the tubular, the blade dimensions may be selected to permit the tubular to pass between the shavers 302. In such cases, the shaver 302 is pierced by the piercing point 300, and cutting surfaces 306 along the front face 303 of the blade between the shavers 302 may be used to shave and/or shear away portions of the tubular and sever therethrough.

The blades described herein may be constructed of any suitable material for cutting the tubular 118, such as steel. Further, the blade may have portions, such as the points 300, 302, and/or blade cutting surfaces 306 that are hardened and/or coated in order to prevent wear of the blades. The hardening may be achieved by any suitable method such as, hard facing, heat treating, hardening, changing the material, inserting a hardened material 352 (as shown in FIG. 3A) such as poly diamond carbonate, INCONEL™ and the like.

Figure 4A:
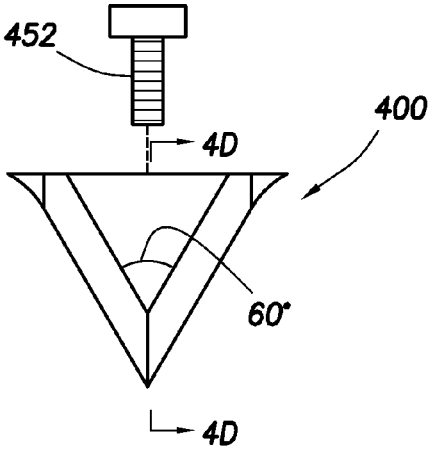
FIGS. 4A-4D are various schematic views of a replaceable blade tip.
Figure 4B:
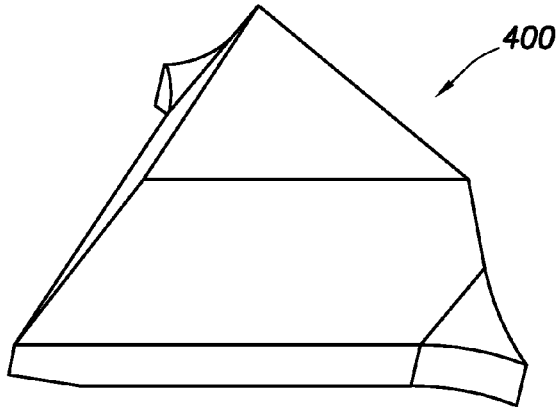
Figure 4C:
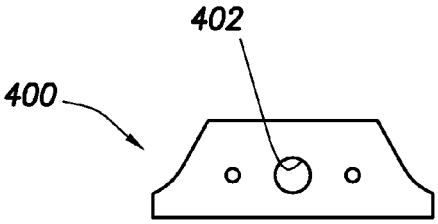
Figure 4D:
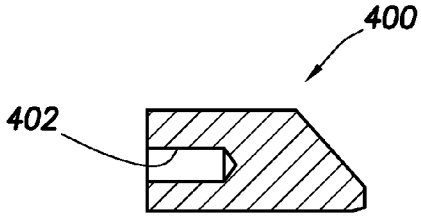

Each of the blades herein may have replaceable blade tips 400 as shown in FIGS. 4A-4D. FIG. 4A is an exploded top view of the blade tip 400. FIG. 4B is a perspective view of the blade tip 400. FIG. 4C is an end view of the blade tip 400. FIG. 4D is a cross-sectional view of the blade tip 400 of FIG. 4A taken along line 4D-4D.

The replaceable blade tips 400 may be sized to replace part or all of any of the tips and/or points described herein, such as the piercing points 300 and the shavers 302 of blade 350 (as shown in FIGS. 3A-3G). Further, there may be a replaceable blade cutting surface (not shown) that may replace part or all of the front face of the blade, such as the cutting surfaces 306 of shavers 302 of blade 350 of FIGS. 3A-3G.

The replaceable blade tips 400 may be used to replace worn and/or damaged parts of existing blades. The replaceable blade tips 400 may have compatible shapes and edges to conform to, for example, the piercing point 300 and related tip 314 and cutting surfaces 306 of the original blade. In some cases, the replaceable blade tips 400 may provide alternate shapes, sizes and/or materials to provide variable configurations for the blade. For example, the replaceable blade tips 400 may be used to provide an extended piercing point 300 to vary the points of contact of the blade.

The replaceable blade tips 400 may be constructed with the same material as the blade 350 and/or any of the hardening materials and/or methods described herein. The replaceable blade tips 400, as shown, may have the same shape as any of the piercing points 300 and/or shavers 302 described herein, and may have one or more connector holes 402 for receiving a connector 452 for coupling the replaceable tips 400, for example, to the blades 150 and/or 350 (as shown in FIGS. 1-3G). The replaceable tips 400 may have a tip angle λ at, for example, an acute angle of about 60 degrees.

Figure 5A:
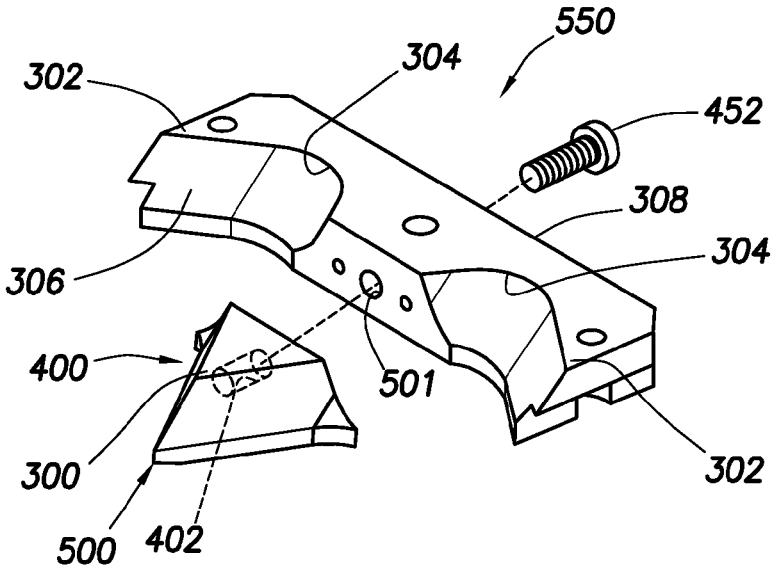
FIGS. 5A-5G are various schematic views of an alternate blade having a replaceable blade tip.
Figure 5B:
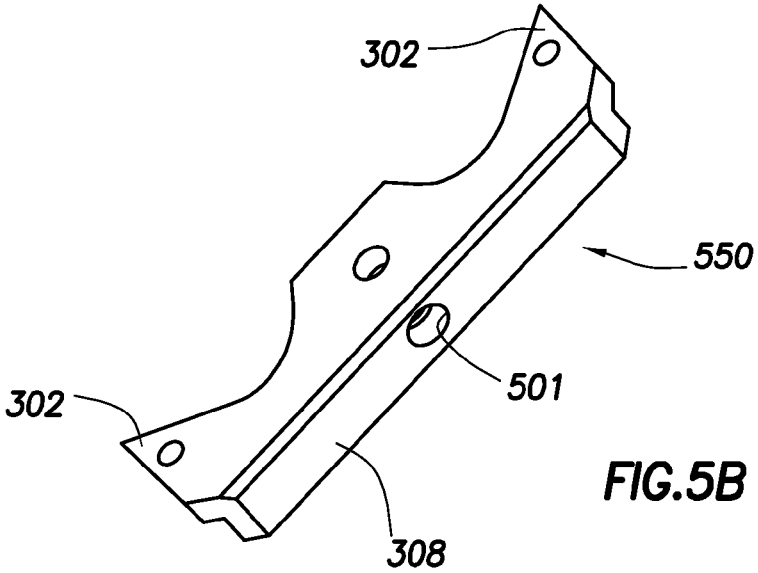
Figure 5C:
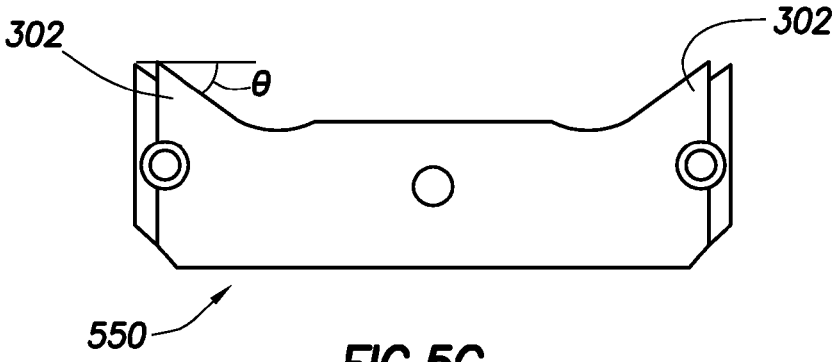
Figure 5D:
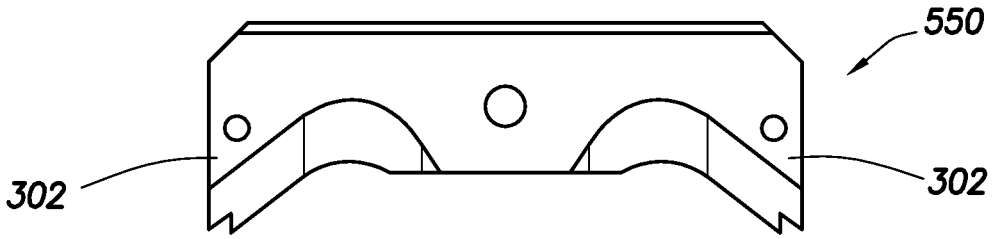
Figure 5E:
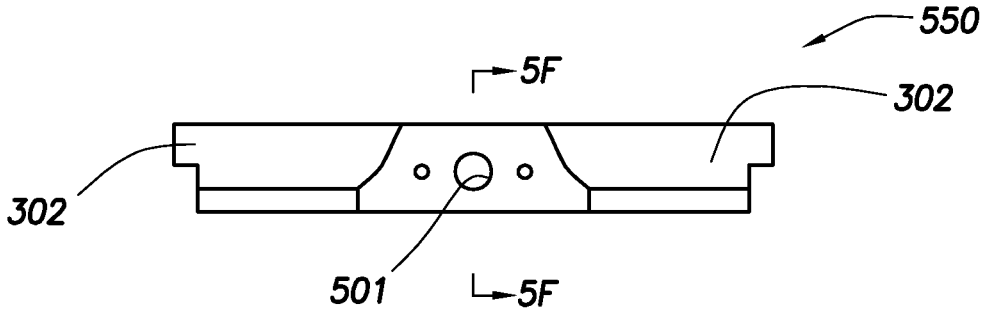
Figure 5F:
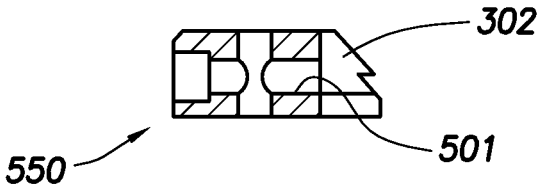
Figure 5G:
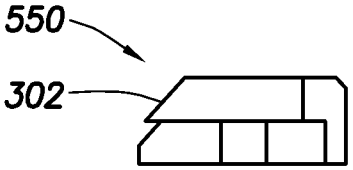

FIGS. 5A-5G show various views of a blade 550 usable, for example, as the blade 150 of FIGS. 1-2C. FIG. 5A shows a front perspective view of the blade 550. FIG. 5B shows a back perspective view of the blade 150. FIG. 5C shows a bottom view of the blade 550. FIG. 5D shows a top view of the blade 550. FIG. 5E shows a front view of the blade 550. FIG. 5F shoes a side cross-sectional view of the blade 550 of FIG. 5E along line 5F-5F. FIG. 5G shows a side view of the blade 550.

The blade 550 may be similar to the blade 350 of FIGS. 3A-3G, except that, in this configuration, the blade 550 defines a different blade shape. The blade 550 as shown is provided with the piercing point (or projection) 300 with an angled piercing tip 500, the one or more shavers (or shavers) 302, the one or more blade cutting surfaces 306, the one or more troughs (or recesses) 304, the loading surface 308, and the one or more apertures 310. In this version, the piercing point 300 extends beyond the shavers 302, and the shavers have an exit angle θ facing toward the piercing point 300. Additionally, the blade 550 may be configured to incorporate, for example, the replaceable blade tip 400 (as shown in FIG. 4A-4D).

As shown, the piecing point 300 is a replaceable blade tip 400 that has been removed for replacement. The blade 550 may have a blade connector hole 501 configured to align with one or more connector holes 402 on the replaceable blade tip 400. A connector 452, such as a bolt and the like, may be used to couple the replaceable blade tip 400 with the blade 550. While these figures show the piercing point 300 as a replaceable tip 400, it will be appreciated that the shavers 302 may also be replaceable. Also, while FIGS. 5A-5G show a specific blade configuration, any blade configuration may be provided with one or more replaceable tips 400. The replaceable blade tip 400 may take the shape of, for example, any of the piercing points 300 and/or shavers 302 provided herein.

Figure 6A:
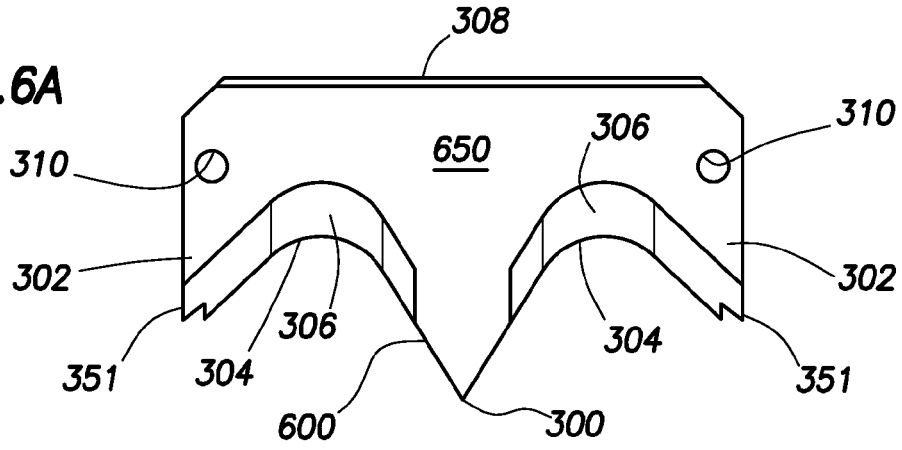
FIGS. 6A-6H are various schematic views of another alternate blade.
Figure 6B:
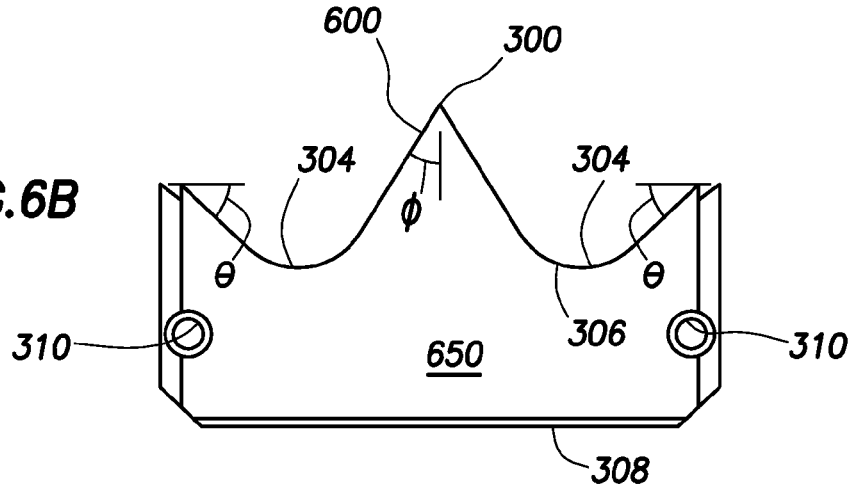
Figure 6C:
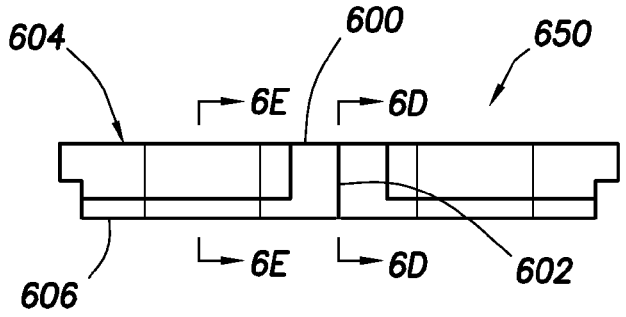
Figure 6D:
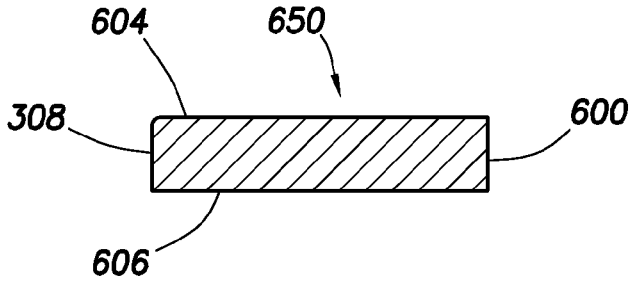
Figure 6E:
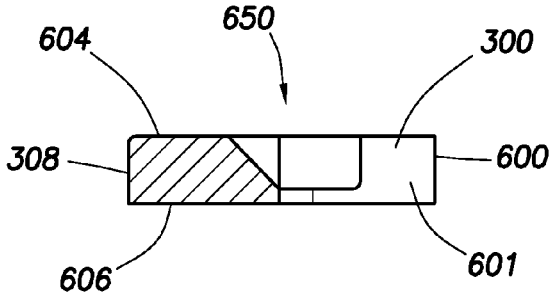
Figure 6F:
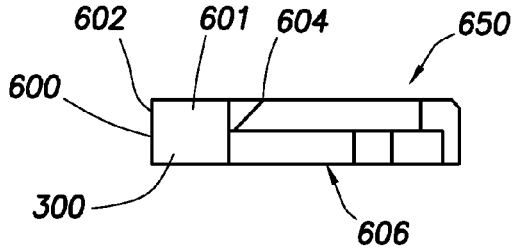
Figure 6G:
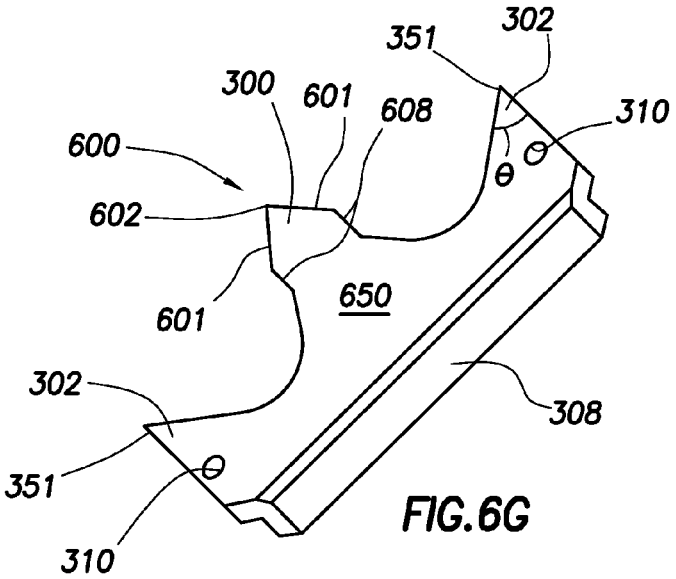
Figure 6H:
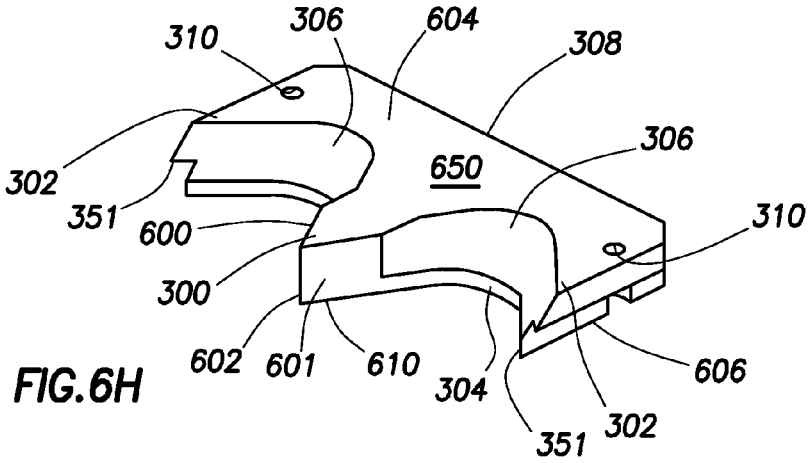

FIGS. 6A-6H depict various views of a blade 650 usable as the upper blade 150*a* and/or the lower blade 150*b* of FIGS. 2A-2C. FIG. 6A shows a top view of the blade 650. FIG. 6B depicts a bottom view of the blade 650. FIG. 6C depicts a front view of the blade 650. FIG. 6D depicts a cross-sectional view of the blade 650 of FIG. 6C taken along line 6D-6D. FIG. 6E depicts a cross-sectional view of the blade 650 of FIG. 6C taken along line 6E-6E. FIG. 6F depicts a side view of the blade 650. FIG. 6G depicts another perspective view of the blade 650. FIG. 6H depicts a perspective view of the blade 650 taken from line 6H-6H of FIG. 6G.

The blade 650 is preferably configured to pierce, rake, shear and/or shave as the blade 650 travels through a tubular, such as the tubular 118 of FIG. 1. The blade 650 may be similar to the blade 350 of FIGS. 3A-3G, except that, in this configuration, the blade 650 defines a different blade shape. The blade 650 as shown is provided with the piercing point (or projection) 300 with an angled piercing tip 600, the one or more shavers (or shavers) 302, the one or more blade cutting surfaces 306, the one or more troughs (or recesses) 304, the loading surface 308, and the one or more apertures 310.

The shavers 302 of blade 650 terminate at the projection 351. The shavers 302 may have a pointed configuration that may be used for piercing the tubular when in contact therewith. In this version, the angled piercing tip 600 extends beyond the shavers 302, and the shavers have an exit angle θ facing toward the piercing point 600. The piercing point 300 for the blade 650 shown in FIGS. 6A-H terminates at the angled puncture tip 600.

The angled puncture tip 600 may be configured to have two puncture walls 601 extending from a leading edge 602. The leading edge 602, as shown in FIG. 6H, may extend from a top 604 to a bottom 606 of the blade 650 in a direction substantially parallel to a longitudinal axis of the tubular 118 (as shown in FIG. 1). The two puncture walls 601 may extend from the leading edge 602 toward the troughs 304 at an angle $\phi$. The two puncture walls 601 may extend from the top 604 to the bottom 606 as they extend toward the troughs 304 until the two puncture walls 601 reach parallel walls 608, as shown in FIG. 6G.

The parallel wall 608 may be walls, or a portion of the walls, that extend substantially parallel to the cutting direction of the blade 650. As shown in FIG. 6H, the parallel walls 608 extend linearly toward the troughs 304 on the upper portion of the blade, while a lower portion 610 of the angled puncture tip 600 continues to extend at the angle $\phi$ until the lower portion 610 meets the trough 304 as shown in FIG. 6B. Above the lower portion and around the trough 304 the blade cutting surface 306 is formed. The blade cutting surface 306 above the lower portion 610 may be configured to substantially align with the one or more shavers 302, or may be offset therefrom.

The angled puncture tip 600 may be configured to have the leading edge 602 engage the tubular 118 first as the blade 650 engages the tubular (as shown in FIG. 1). The leading edge 602 may enter a portion of the tubular 118 while the puncture walls 601 separate the wall of the tubular 118, similar to a chisel. The angled puncture tip 600 may separate and/or remove a portion of the wall of the tubular 118 until the cutting surface 306 of the blade 650 engages the tubular 118.

As shown in FIGS. 6A-6H, a portion of the blade 650 along puncture tip 600 has a vertical surface and a remainder of the blade 650 has an inclined surface. As demonstrated in these figures, portions of the blade 650 may have vertical and/or inclined surfaces.

Figure 7A:
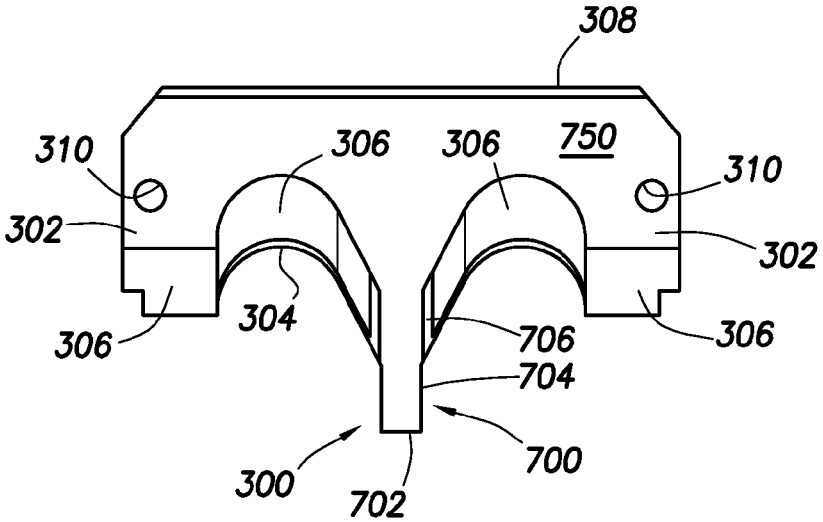
FIGS. 7A-7G are various schematic views of another alternate blade.
Figure 7B:
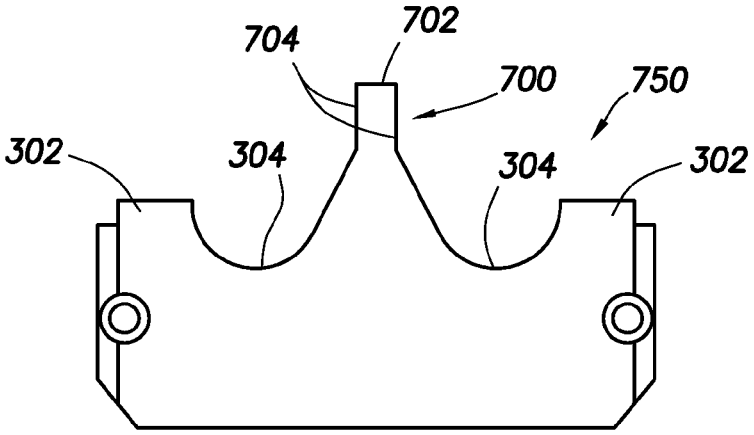
Figure 7C:
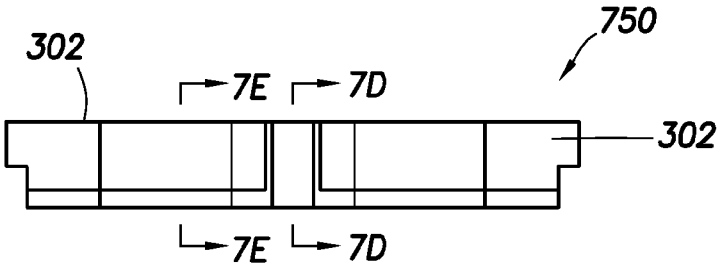
Figure 7D:
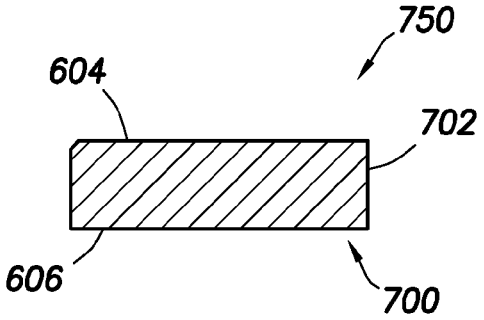
Figure 7E:
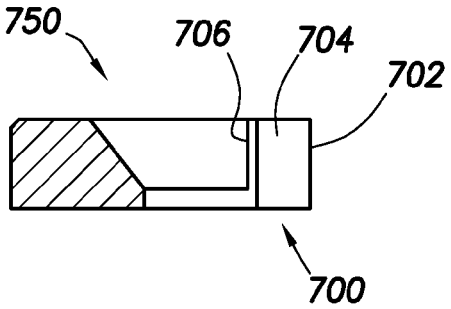
Figure 7F:
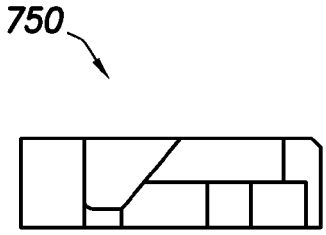
Figure 7G:
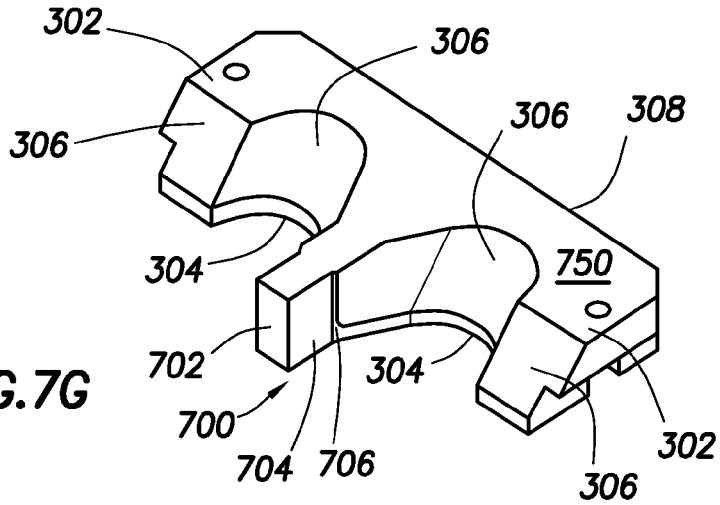

FIGS. 7A-7G depict various views of a blade 750 usable as the upper blade 150*a* and/or the lower blade 150*b* of FIGS. 2A-2C. FIG. 7A shows a top view of the blade 750. FIG. 7B depicts a bottom view of the blade 750. FIG. 7C depicts a front view of the blade 750. FIG. 7D depicts a cross-sectional view of the blade 750 of FIG. 7C taken along line 7D-7D. FIG. 7E depicts a cross-sectional view of the blade 750 of FIG. 7C taken along line 7E-7E. FIG. 7F depicts a side view of the blade 750. FIG. 7G depicts a perspective view of the blade 750 of FIG. 7F from the view 7G-7G.

The blade 750 is preferably configured to pierce, rake, shear and/or shave as the blade travels through a tubular, such as the tubular 118 of FIG. 1. The blade 750 may be similar to the blade 350 of FIGS. 3A-3G, except that, in this configuration, the blade 750 defines a different blade shape. The blade 750 as shown is provided with the piercing point (or projection) 300, the one or more shavers (or shavers) 302, the one or more blade cutting surfaces 306, the one or more troughs (or recesses) 304, the loading surface 308, and the one or more apertures 310. The blade 750 may be similar to the blade 350 of FIGS. 3A-3G, except that the shavers 302 and the piercing point 300 have alternate shapes. The blade 750 may have a square puncture tip 700. The flat puncture face 702 of the shavers 302 may have flat walls 704 extending therefrom. The sloped cutting surfaces 306 may wedge into the tubular during engagement.

The piercing point 300 for the blade 750 shown in FIGS. 7A-H is a square puncture tip 700. The square puncture tip 700 may have a flat puncture face 702. The flat puncture face 702 as shown is a rectangular surface, although it may have any shape. The flat puncture face 702 may extend from the top 604 to the bottom 606 of the blade 750 in a direction substantially parallel to a longitudinal axis of the tubular 118 (as shown in FIG. 1). Two parallel puncture walls 704 may extend from the flat puncture face 702 toward the troughs 304 in a direction that is substantially parallel to the cutting direction of the blade 750. The two parallel puncture walls 704 may extend from the top 604 to the bottom 606 of the blade 750 as they extend toward the troughs 304. A parallel puncture step 706 may be configured to transition the square puncture tip 700 into the cutting surfaces 306 proximate the troughs 304.

The square puncture tip 700 may be configured to have the flat puncture face 702 engage the tubular 118 first as the blade 750 engages the tubular (as shown in FIG. 1). The flat puncture face 702 may puncture, dent and/or enter a portion of the tubular 118. The square puncture tip 700 may separate and/or remove a portion of the wall of the tubular 118. With the puncture tip 700 extending beyond the shavers 302, the puncture tip 700 may engage the tubular before the shavers 302 of the blade 750 engage the tubular 118.

Figure 8A:
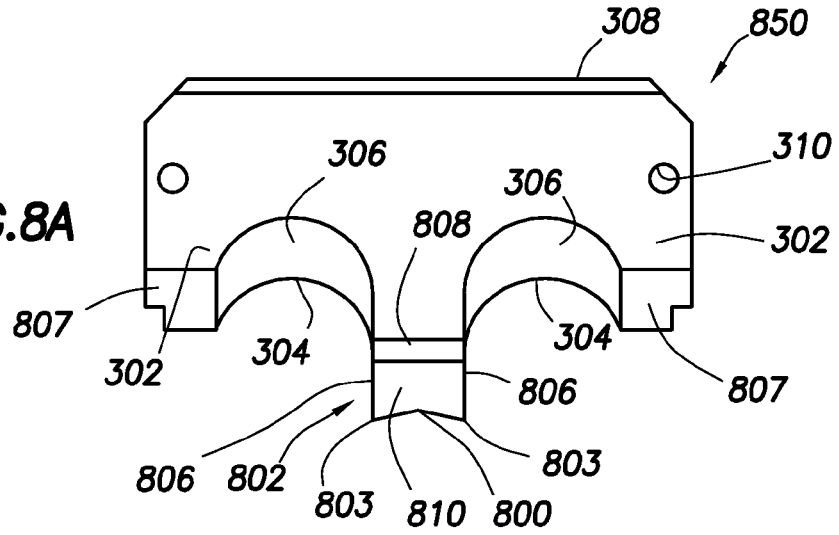
FIGS. 8A-8G are various schematic views of another alternate blade.
Figure 8B:
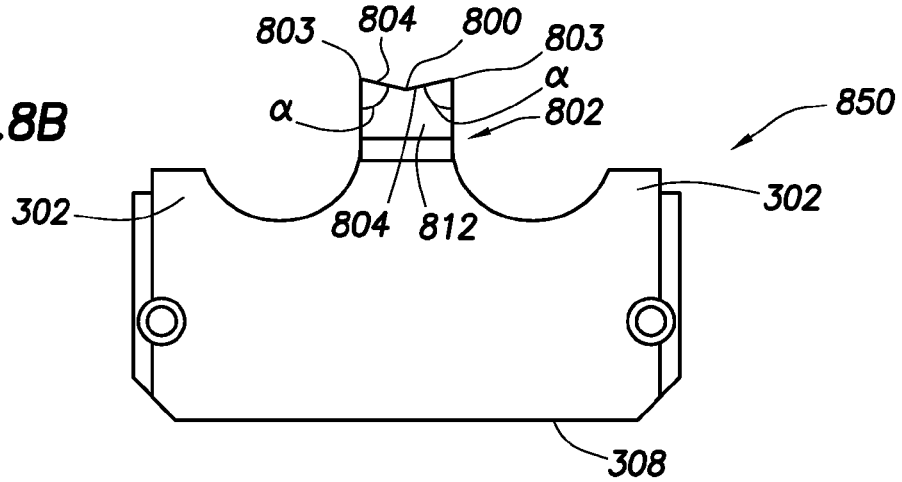
Figure 8C:
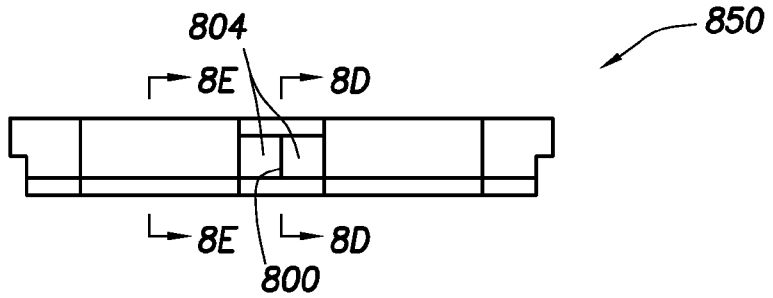
Figure 8D:
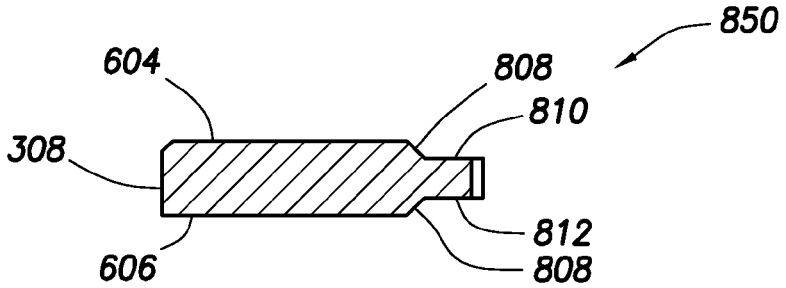
Figure 8E:
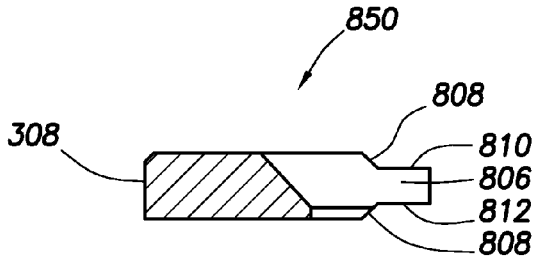
Figure 8F:
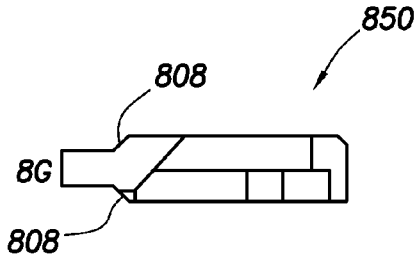
Figure 8G:
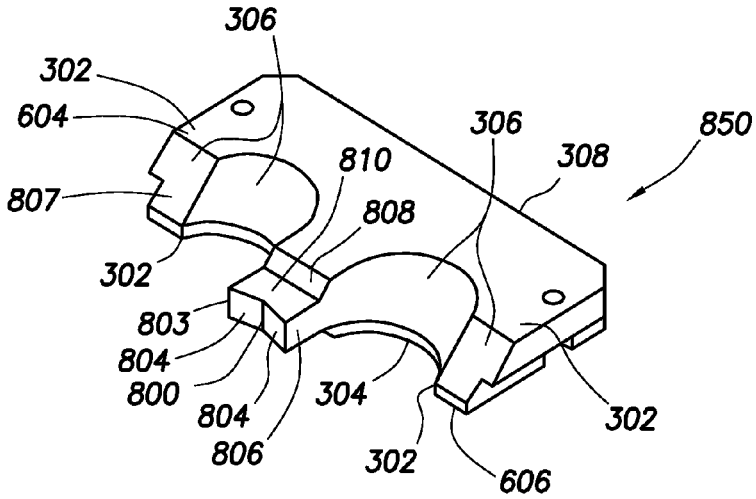

FIGS. 8A-8G depict various views of a blade 850 usable as the upper blade 150*a* and/or the lower blade 150*a* of FIGS. 2A-2C. FIG. 8A shows a top view of the blade 850. FIG. 8B depicts a bottom view of the blade 850. FIG. 8C depicts a front view of the blade 850. FIG. 8D depicts a cross-sectional view of the blade 850 of FIG. 8C taken along line 8D-8D. FIG. 8E depicts a cross-sectional view of the blade 850 of FIG. 8C taken along line 8E-8E. FIG. 8F depicts a side view of the blade 850. FIG. 8G depicts a perspective view of the blade 850 of FIG. 8F from the view 8G-8G.

The blade 850 is preferably configured to pierce, rake, shear and/or shave the tubular 118 as the blade 850 travels through a tubular, such as the tubular 118 of FIG. 1. The blade 850 may be similar to the blade 350 of FIGS. 3A-3G, except that, in this configuration, the blade 850 defines a different blade shape. The blade 850 as shown is provided with an inverted point 800 located between two piercing points (or projections) 803. The blade 850 is further provided with the one or more shavers (or shavers) 302, the one or more blade cutting surfaces 306, the one or more troughs (or recesses) 304, the loading surface 308, and the one or more apertures 310. The blade 850 may be similar to the blade 350 of FIGS. 3A-3G, except that the shavers 302 and the piercing point 300 have alternate shapes. The blade 850 may have a flat shave front 807. The flat shave front 807 of the shavers 302 may have a sloped cutting surface 306 extending therefrom. The sloped cutting surfaces 306 may wedge into the tubular during engagement.

The piercing point 300 has been reconfigured as an inverted puncture tip 802. An inverted point 800 is positioned between two piercing points 300 for the blade 850 shown in FIGS. 8A-H to form an inverted puncture tip 802. The inverted puncture tip 802 may have two inverted surfaces 804 extending from the inverted point 800 at an angle $\alpha$ toward the piercing points 300. The angle $\alpha$ may be any suitable angle that allows the piercing points 300 to engage the tubular prior to, or simultaneously with, the inverted point 800 engaging the tubular. The two inverted surfaces 804 may be rectangular shaped surfaces, or any other suitable shape.

The inverted puncture tip 802 may only extend a portion of the depth of the blade 850 between the top 604 and the bottom 606, as shown, or may extend the entire depth in a direction substantially in line with a longitudinal axis of the tubular 118 (as shown in FIG. 1). A stepped blade surface 808 may extend from a parallel top 810 and/or a parallel bottom 812 of the inverted puncture tip 802. The parallel top 810 may be a distance below the top surface 604. The parallel bottom 812 may be a distance above the bottom surface 606.

Two parallel puncture walls 806 may extend from the piercing points 300 toward the troughs 304 in a direction that is substantially parallel to the cutting direction of the blade 850. The parallel top 810 and the parallel bottom 812 may extend from the top 604 and bottom 606 (respectively) of the inverted surfaces 804 toward the stepped blade surface 808.

The inverted puncture tip 802 may be configured to have the piercing points 803 engage the tubular 118 first as the blade 850 engages the tubular (as shown in FIG. 1). The piercing points 300 may puncture, dent, and/or enter a portion of the tubular 118 prior to or at substantially the same time as the inverted piercing point 800. The inverted puncture tip 802 may separate and/or remove a portion of the wall of the tubular 118 until the cutting surface 306, the stepped blade surfaces 808 and/or the shavers 302 of the blade 850 engage the tubular 118.

Figure 9:
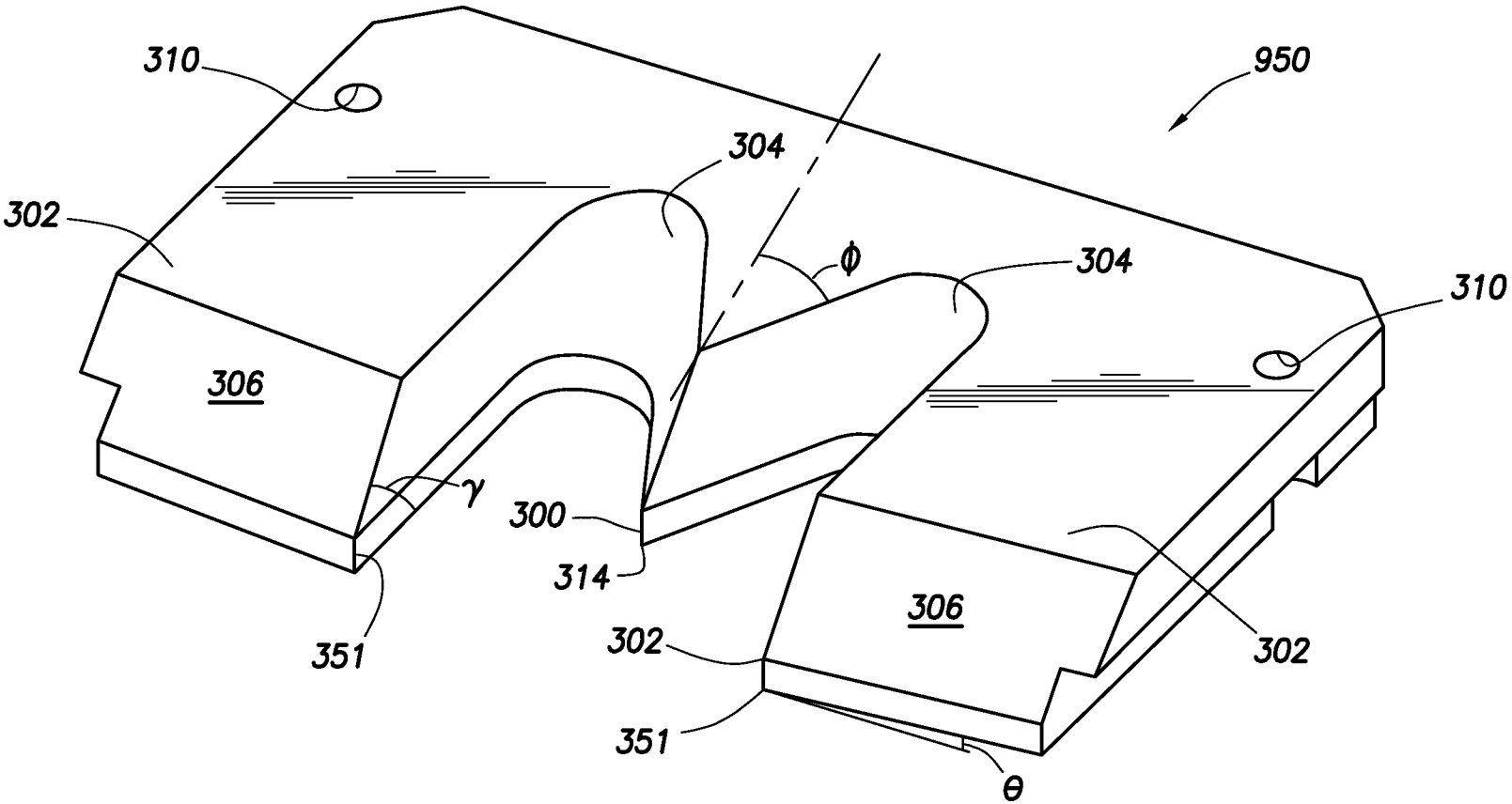
FIGS. 9-15 are schematic views of various other alternate blades.
Figure 10:
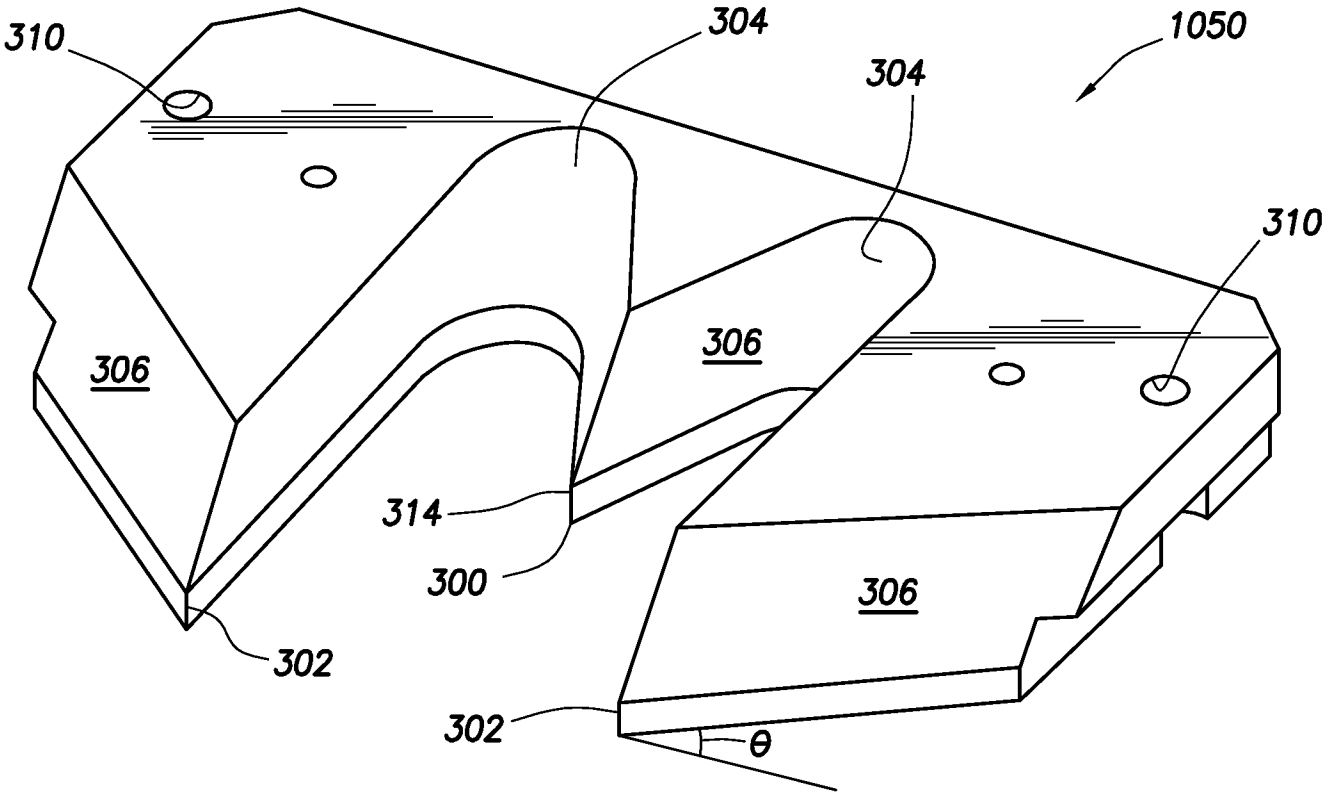

FIGS. 9-15 shows perspective views of other shapes that the blade 150 may take. Each of the blades of FIGS. 9-15 may be similar to the blade 350 of FIGS. 3A-3G, except having different blade shapes. FIGS. 9 and 10 depict blades with 'shave and puncture' profiles. FIG. 9 shows a blade 950 having flat shavers 302 and a piercing point 300. The shavers 302 have sloped cutting surfaces 306. The shavers 302 have projections 351 at a point thereon. The cutting surfaces 306 may be formed with, for example, a shallow exit angle θ along the face of the shavers 302 (and/or other portions of the blade 950). The shallow exit angle θ may be a small angle of, for example, less than about 30 degrees. The cutting surfaces 306 may also have a slope (or blade) angle γ. The piercing point 300 defines a piercing point (or puncture tip) 314 at a tip angle Φ. The blade 950 has a blade body with a base 350 along a bottom side thereof.

FIG. 10 is similar to FIG. 9, except that the exit angle θ has increased and the piercing point 300 is further recessed. In FIG. 10, a blade 1050 having the piercing point 300 with the troughs 304, and the shavers 302 is provided. The shavers 302 have cutting surfaces 306 at a sharp exit angle θ. The sharp exit angle θ may be a large angle, for example, more than about 30 degrees and less than about 90 degrees.

Figure 11:
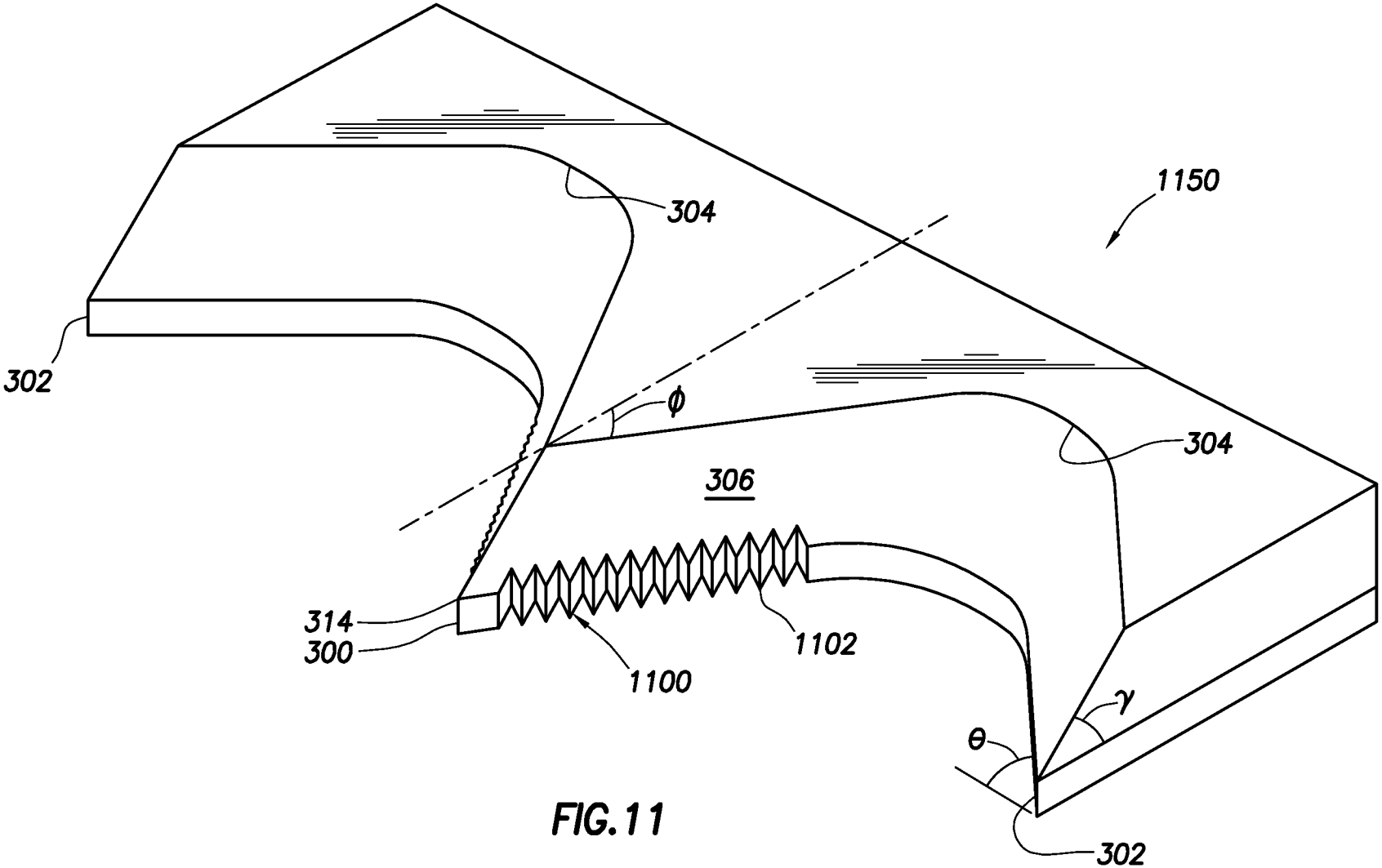

FIG. 11 depicts a blade 1150 with a serrated puncture profile. In FIG. 11, the blade 1150 has the piercing point 300 with the troughs 304, the shavers 302, and a serrated edge 1100. The serrated edge 1100 is shown on the blade 1150 along cutting surface 306 on either side of the piercing point 300. However, the serrated edge 1100 may be on any of the cutting surfaces 306. The serrated edge 1100 may have a plurality of serration tips (or serrations) 1102 for engaging and cutting the tubular 118. As also shown in FIG. 11, the shavers 302 may have an exit angle θ facing the piercing point 300. The exit angle θ may be, for example, about 45 degrees. As also shown in this Figure, the cutting surface 306 may extend along the entire front face of the blade 1150, and have a cutting angle γ along the entire front face.

Figure 12:
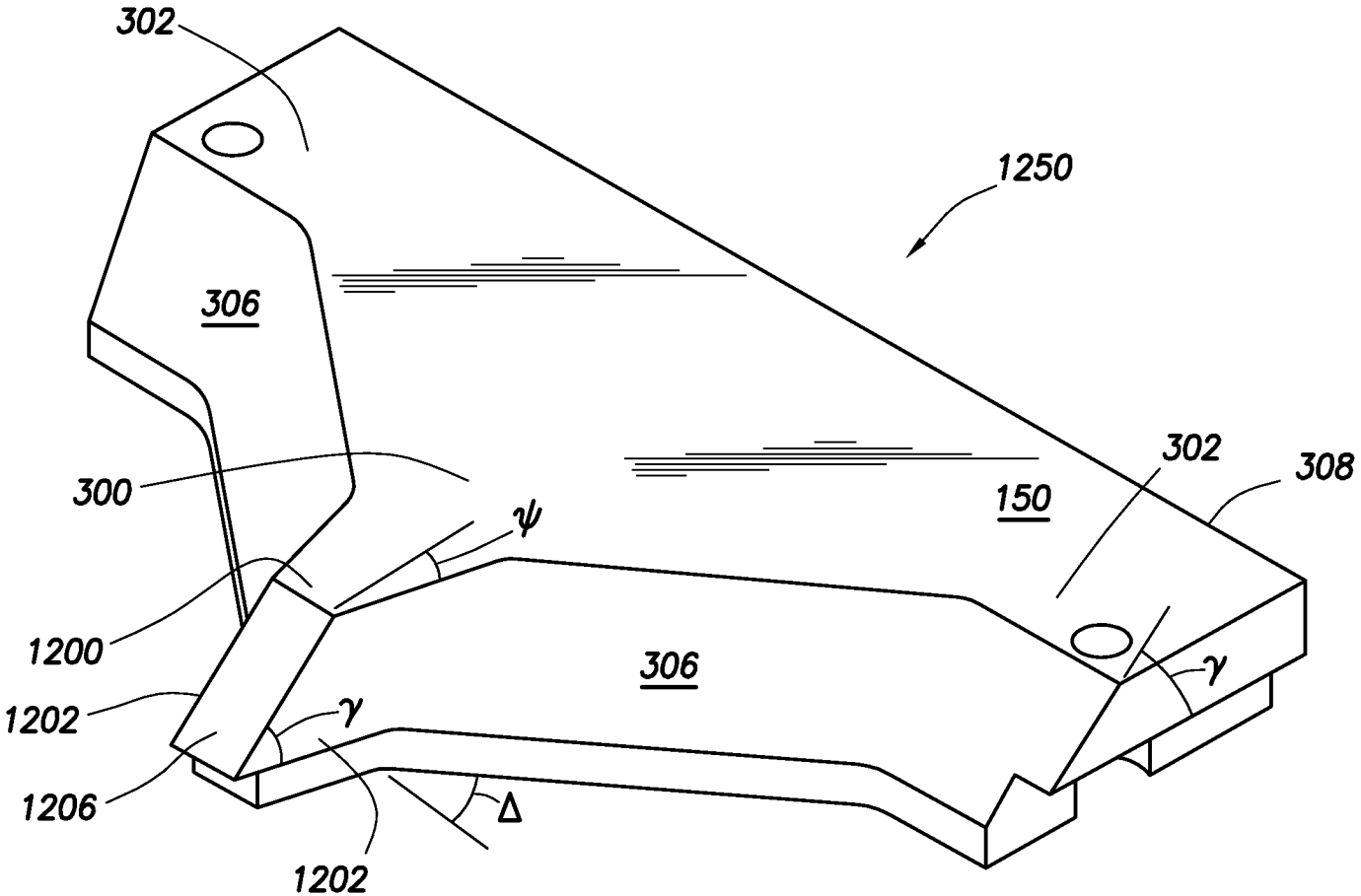

FIG. 12 depicts a blade 1250 having a flat tip and a flat puncture profile. The blade 1250 has an extended piercing point 300 and flush shavers 302. In FIG. 12, the piercing point 300 of the blade 150 has a flat puncture tip 1200, blade cutting surfaces 306 proximate the flat puncture tip 1200, tip engagement portions 1202, a tip cutting angle ψ and a flat front 1206. The flat puncture tip 1200 as shown has a rectangular profile configured to engage the tubular 118 (as shown in FIG. 1), although it may have any shape such as square, circular, polygonal and the like. The flat puncture tip 1200 may be on a portion of the blade 1250 extending from the flat front 1206 toward a back of the loading surface 308 of the blade 1250.

As shown, the tip engagement portions 1202 extend substantially parallel to one another along a length of the flat puncture tip 1200, however, they may form an angle (not shown). The tip engagement portion 1202 may be at a side cutting angle Δ to the flat front 1206 and may have the blade cutting surfaces 306 thereon. The side cutting angle Δ may have any suitable angle for cutting the tubular 118 (as shown in FIG. 1). A series of cutting surfaces 306 are depicted as extending from the flat puncture tip 1200 at various angles therefrom.

The shavers 302 are depicted as being flat surfaces having an exit angle θ of zero degrees parallel to the loading surface 308. The shavers 302 have the cutting surfaces 306 thereon extending at a blade cutting angle γ. The blade cutting angle γ of the cutting surfaces 306 may be constant along the shaver 302 and/or the blade 1250. The flat front 1206 may also have the same cutting angle γ.

Figure 13:
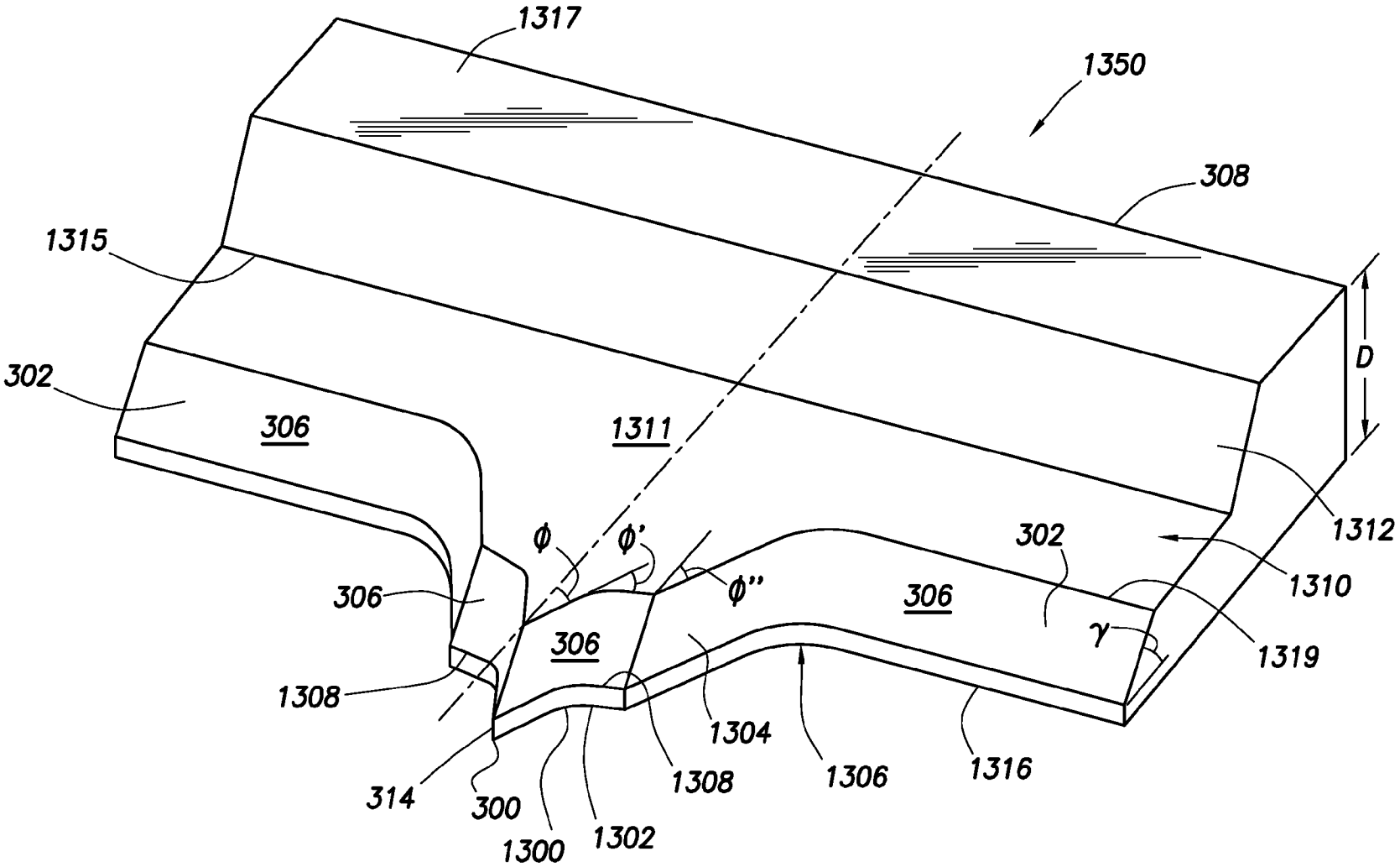

FIG. 13 depicts a blade 1350 having a broach tip profile. The blade 1350 has an extended piercing point 300 and flush shavers 302. In FIG. 13, the blade 1350 also has the blade cutting surface 306 along the entire front fact of the blade 1350, a broach trough 1300, a broach shoulder 1302, a broach portion 1304, an exit trough 1306, and a flat front 1316. The shavers 302 are depicted as being flat surfaces having an exit angle θ of zero degrees parallel to the loading surface 308 and defining the flat front 1316. The flat front 1316 may be similar to the flat fronts described herein. The shavers 302 have the cutting surfaces 306 thereon extending at a blade angle γ. The blade angle γ of the cutting surfaces 306 may be constant along the shaver 302 and/or the blade 1350.

The piercing tip 300 has the blade cutting surfaces 306 on either side that extends a distance from a tip 314 of the piercing tip 300 to the broach trough 1300 at a tip angle Φ. At the broach trough 1300 the tip angle Φ of the blade cutting surface 306 changes to tip angle Φ' to form an angled blade step 1308. The angled blade step 1308 ends at the broach portion 1304 wherein the angle of the blade cutting surface 306 changes again to tip angle Φ" to form the blade cutting surface 306 at the broach portion 1304. The blade cutting surface 306 may extend from the broach shoulder 1302 along the broach portion 1304 to the exit trough 1306. The exit trough 1306 may be a continuous curve from of the blade cutting surface 306 from the broach portion 1304 to the flat front 1316.

The blade 1350 of FIG. 13 may further have a stepped blade front 1310. The stepped blade front 1310 may divide a depth D of the blade 1350, thereby forming a lower plateau 1311 and an upper plateau 1317. The lower plateau 1311 is positioned between a top edge 1319 of the blade cutting surface 306 and a bottom edge 1315 of a second blade cutting surface 1312. The second blade cutting surface 1312 may have a similar pitch as the blade cutting surface 306, or have a different pitch. Further, the second blade cutting surface 1312 may be perpendicular to the direction of blade cutting travel. The upper plateau 1317 extends from the cutting surface 1312 to the loading surface 308. One or more plateaus and/or shoulders at various angles may be provided.

Figure 14:
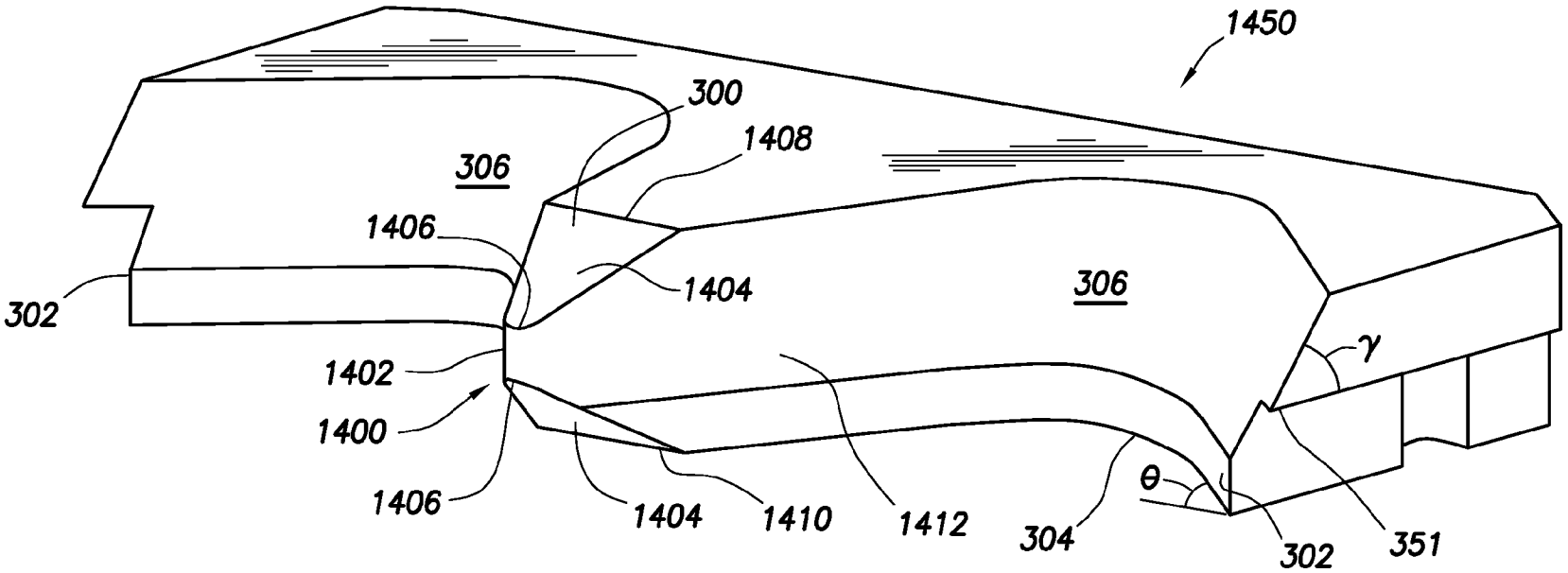

FIG. 14 provides a blade 1450 with a balanced tip and rake on trough profile. The blade 1450 has a piercing point 300 and shavers 302 with sloped troughs 304 therebetween. In FIG. 14, the blade 1450 has a balanced tip 1400 having a rounded point 1402 and an equal bevel 1404 on each side of the rounded tip 1402. The rounded point 1402 may be a semi-cylindrical nose that is formed at the front of the piercing point 300 of blade 1450. The semi-cylindrical nose may be raised or extend in a perpendicular direction relative to the blade cutting direction. The bevels 1404 may extend equally from a nose end 1406 to a blade top 1408 and/or a blade bottom 1410 to provide a balance at the rounded tip 1402. The rounded point 1402 may extend along a bevel edge 1412 until the blade cutting surface 306 is reached at the trough 304.

The blade 1450 further has the blade cutting surface 306 that may be located at the troughs 304. The trough 304 may extend back toward the cutting direction to form the shavers 302 at either end of the blade 1450. The shavers 302 have projections 351 at a point thereof. Each of the cutting surfaces 306 extends from the projection 351 along an inner surface of the shaver 302 at an exit angle θ. The cutting surface 306 along the troughs 304 may be at a blade angle γ to define a rake along a portion of the blade 1450. In this rake configuration, the sloped cutting surfaces 306 at the trough may be used to rake through the tubular 118.

Figure 15:
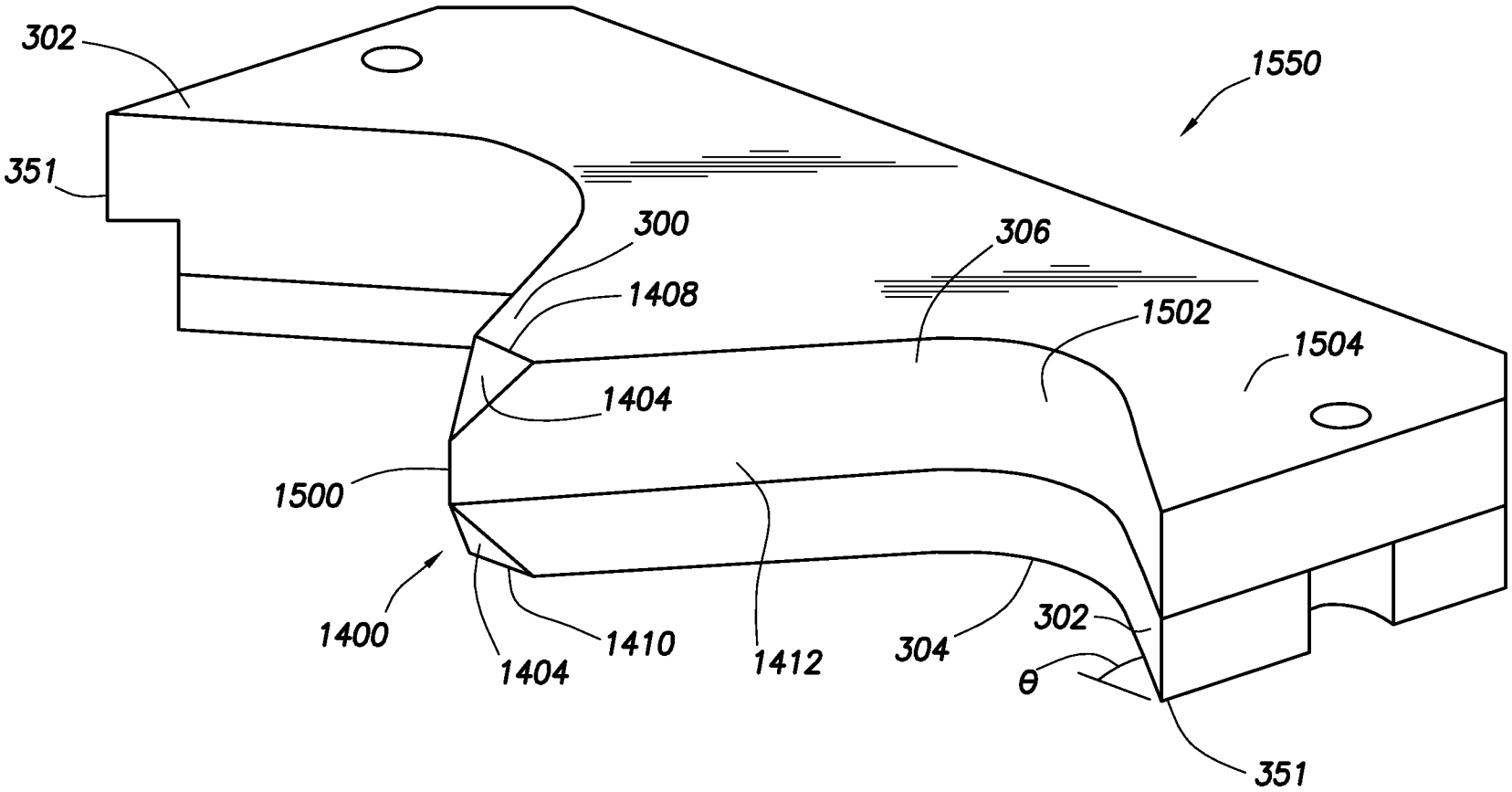

FIG. 15 provides a blade 1550 having a balanced tip and no rake profile. The blade 1550 is provided with a projection 300 and shavers 302 with perpendicular troughs 304 therebetween. In FIG. 15, the blade 1550 has the balanced tip 1400 having a sharp point 1500 and the equal bevels 1404 on top and bottom sides of the sharp tip 1500. The blade 1550 further has the troughs 304 with perpendicular surfaces 1502, along the blade cutting surfaces 306. The sharp point 1500 may be an angled nose that is formed at the front of the blade 1550. The angled nose may extend in a perpendicular direction relative to the blade cutting direction. The equal bevels 1404 may extend from a sharp point 1500 to a blade top 1408 and/or a blade bottom 1410. The sharp point 1500 may extend along the bevel edge 1412 until the blade cutting surface 306 is reached at the trough 304.

The trough 304 may extend back toward the cutting direction to form the shavers 302 at either end of the blade 1550. The shavers 302 have projections 351 at a point thereof. Each of the cutting surfaces 306 extends from the projection 351 along an inner surface of the shaver 302 at an exit angle θ. The perpendicular surfaces 1502 along the troughs 304 may be perpendicular to a top surface 1504 of the blade 1550. Unlike the sloped cutting surfaces 306 of the blade 1450 of FIG. 14, the perpendicular surfaces 1502 of the blade 1550 define a no-rake configuration where the perpendicular cutting surfaces 1502 at the trough may be used to push against the tubular 118.

FIGS. 16A-16J show various views of shapes that the blade 150 (or any other blades herein, such as blades of FIGS. 1-15) may take. Each of these figures depicts various blade profiles 1650*a-j* that may be provided for the blades. The blade profiles 1650*a-j* each have a front face 1615*a-j* defined by the piercing point 300, the shavers 302, the recesses 304 and the blade cutting surfaces 306 of the given blade. The shavers 302 each have a shave front 1604*a-j* for engagement with a tubular (e.g., 118 of FIGS. 1-2C). The dashed line 1600 on each of the blade profiles 1615*a-j* in FIGS. 16A-16J depicts where the blade cutting surfaces 306 may be located. The cutting surfaces 306 may be on part or all of the front face of the blade.

Figure 16B:
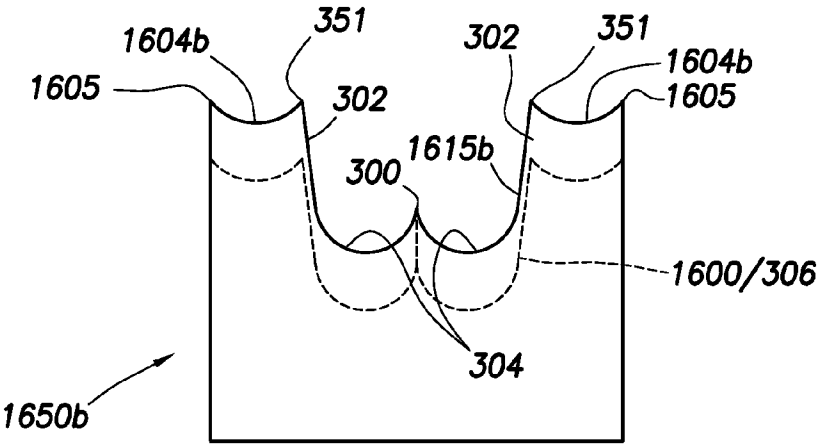
FIGS. 16A-16J are schematic views of various blade profiles.
Figure 16D:
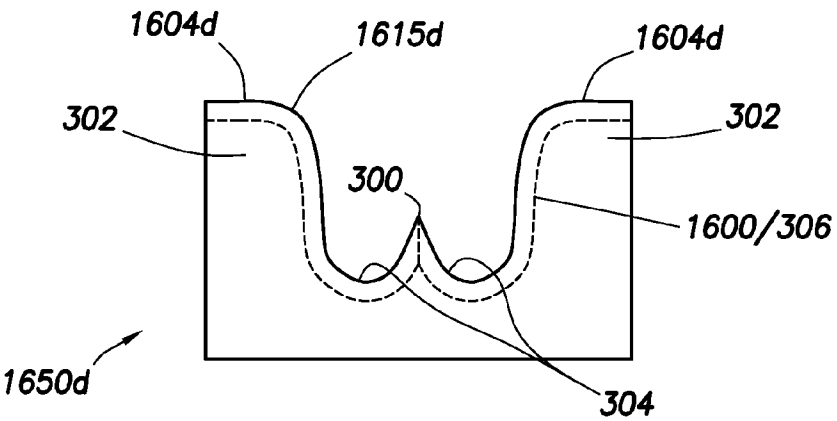
Figure 16A:
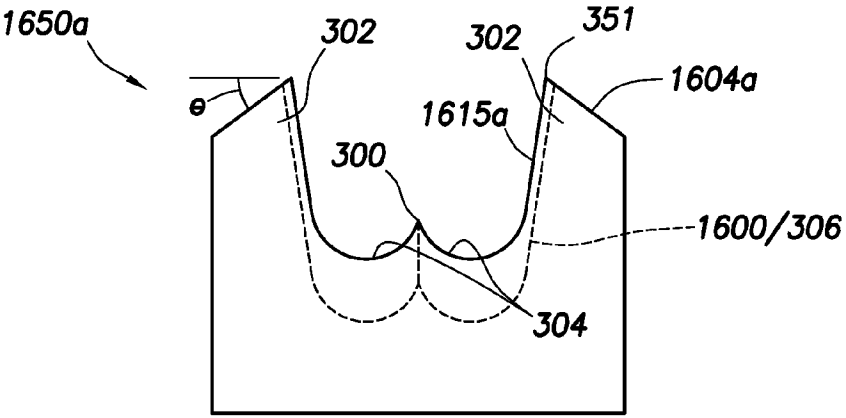
Figure 16C:
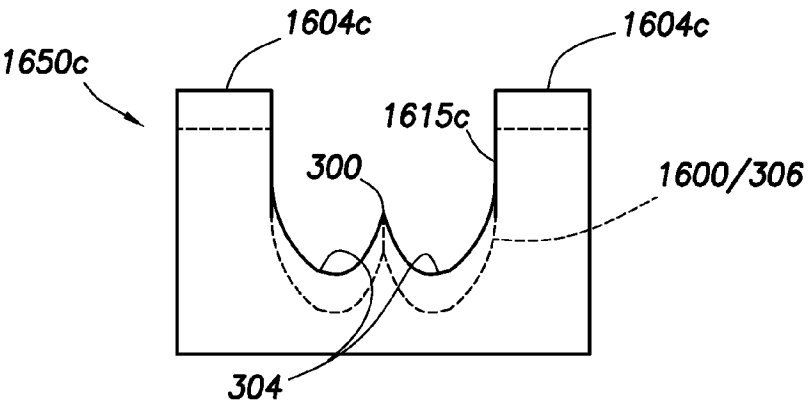

The shavers 302 of the blades may be configured with various shapes. FIG. 16A shows the blade profile 1650*a* having the shavers 302, the piercing point 300 and the exit angle θ. With this blade profile 1650*a*, the shavers 302 contact the pipe before the piercing point 300. The exit angle θ of the shavers 302 provides the shavers 302 with the pointed shave front 1604*a* defining a projection 351 with piercing capabilities similar to that of the piercing point 300. FIG. 16B shows the blade profile 1650*b* having the piercing point 300, the shavers 302, and a U-shaped shave front 1604*b*. The U-shaped shave front 1604*b* may be along the shaver 302 between the projection 351 and a shave front end point 1605. FIG. 16C shows the blade profile 1650*c* having the piercing point 300, and a flat shave front 1604*c*. FIG. 16D shows the blade profile 1650*d* having the piercing point 300, and a continuously curved front face 1615*d* from the shave front 1604*d* to the piercing point 300. In this configuration, the shavers 302 have a curved shape for contact with the tubular 118.

Figure 16F:
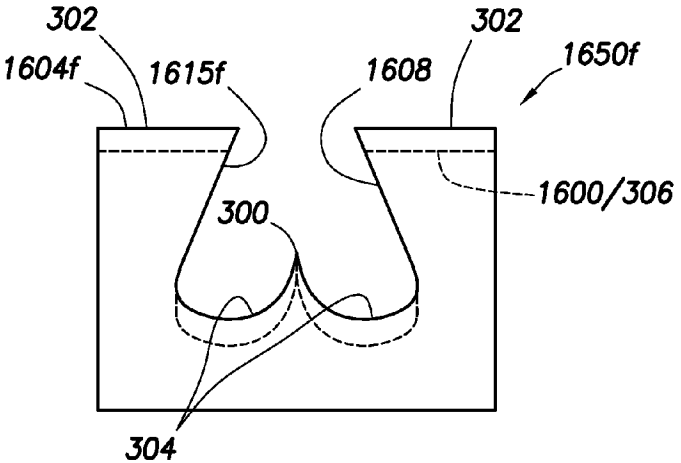

The projections 300 and shavers 302 may be also configured to provide recesses 304 with various shapes. FIG. 16E shows the blade profile 1650*e* having the piercing point 300 with flat troughs 304 extending between the piercing point 300 and the shavers 302, and with a flat shave front 1604*e*. FIG. 16F shows the blade profile 1650*f* having the piercing point 300, and a continuously curved blade edge 1615*f* from the flat shave front 1604*f* to the piercing point 300. As shown in this configuration, inner walls 1608 of the shavers 302 may slant together.

Figure 16H:
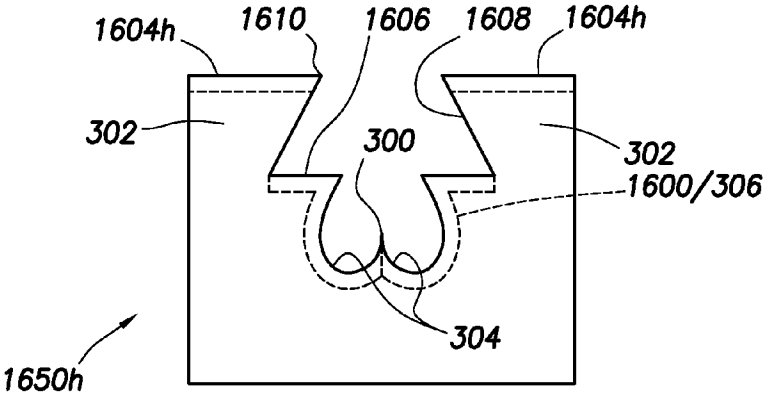
Figure 16E:
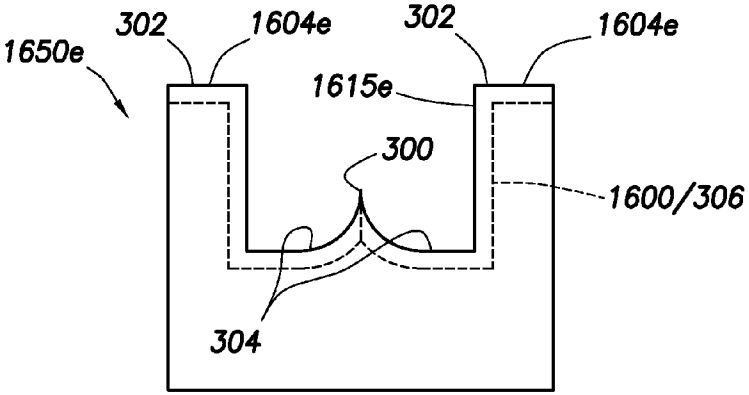
Figure 16G:
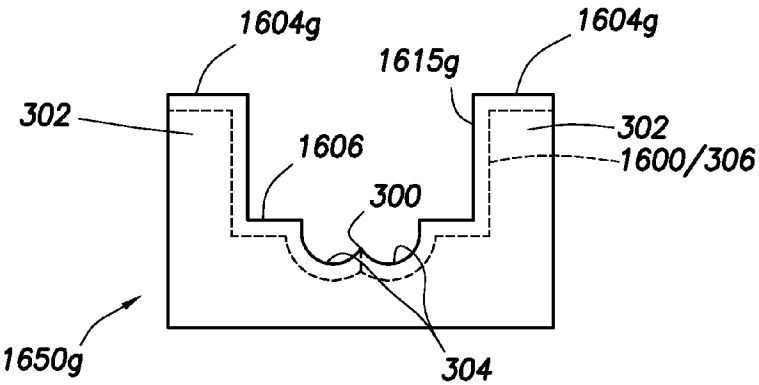
Figure 16I:
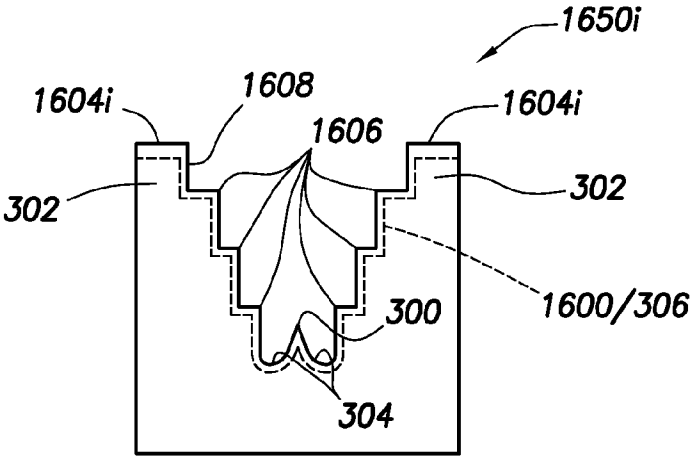

FIGS. 16G-16I show stepped configurations. FIG. 16G shows the blade profile 1650*g* having the piercing point 300, a flat shave front 1604*g*, and a flat stepped front 1606. The flat stepped front 1606 may provide the shave front 302 with an additional contact surface for engaging the pipe. FIG. 16H shows the blade profile 1650*h* having the piercing point 300, the flat shave front 1604*h*, and the flat stepped front 1606, with an inner wall 1608 between the flat shave front 1604*h* and the flat stepped front 1606. The inner wall 1608 may create points 1610 similar to the projection 351 of FIG. 16A. FIG. 16I shows the blade profile 1650*i* having the piercing point 300, the flat shave front 1604*i*, and multiple flat step fronts 1606. As shown in these figures, one or more flat or angled steps may be provided on the inner surfaces (or walls) 1608 of the shavers 302.

Figure 16J:
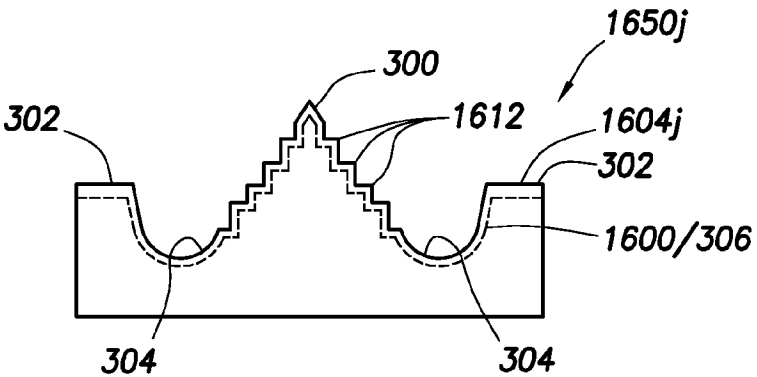

The piercing point 300 may also be configured with various shapes, such as serrations or steps. FIG. 16J shows the blade profile 1650*j* having the piercing point 300, the flat shave front 1604*j*, and multiple stepped, or serrated cutting edges 1612 between the piercing point 300 and the trough 304. The serrated cutting edges may be rounded or pointed as shown. As also demonstrated by this figure, the piercing point 300 may optionally extend further than the shavers 302.

FIGS. 17, 18A-18C, and 19A-D are schematic top views, partially in cross-section of various blades 150, 150*a*, 150*b* engaging a tubular 118. For descriptive purposes, the blades may be schematically depicted as being on opposite sides of the tubular, but may be positioned at different heights along the tubular 118 such that an upper blade 150*a* passes above a lower blade 150*b* as shown in FIGS. 2A and 2B.

Figure 17:
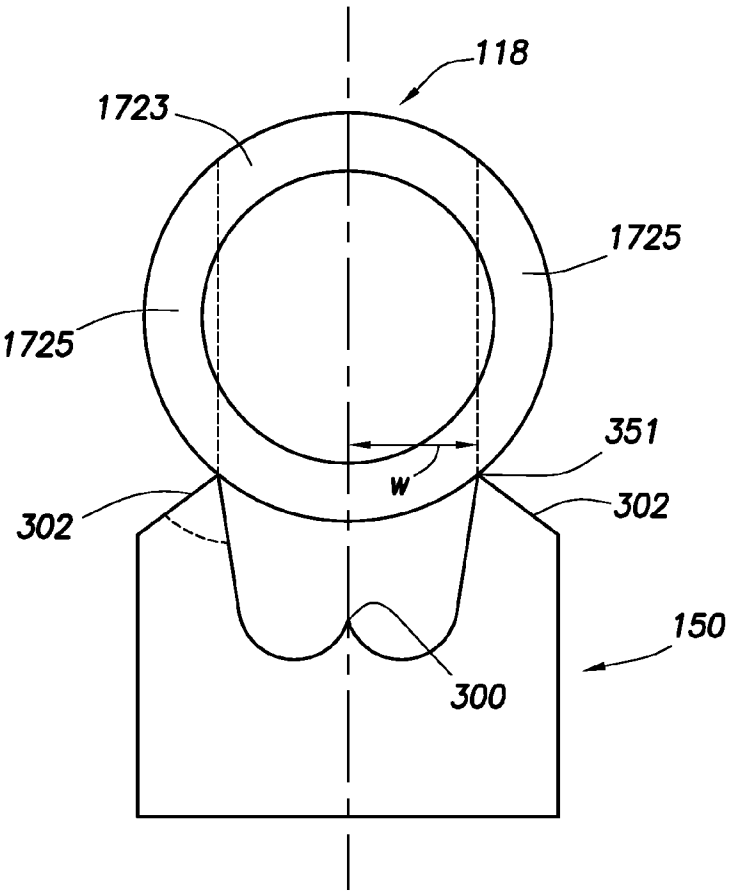
FIG. 17 is a schematic top view, partially in cross-section of a blade engaging a tubular.

FIG. 17 is a schematic diagram depicting the position of a blade 150 about a tubular 118 prior to engagement. The blade 150 may be used in combination with another blade (or blades), but is depicted alone for descriptive purposes. As shown in FIG. 17, the shavers 302 may engage an outer portion 1725 of the tubular 118, and the piercing point 300 may engage a central portion 1723 of the tubular 118. The projections 351 engage the tubular 118 as indicated by the dashed lines a distance W from the piercing point. In some cases, the blades 150 may be configured such that the shavers 302 do not pass through the tubular 118. For example, the width W may be greater than a radius of the tubular 118 such that the tubular 118 passes between the shavers 302.

Figure 18B:
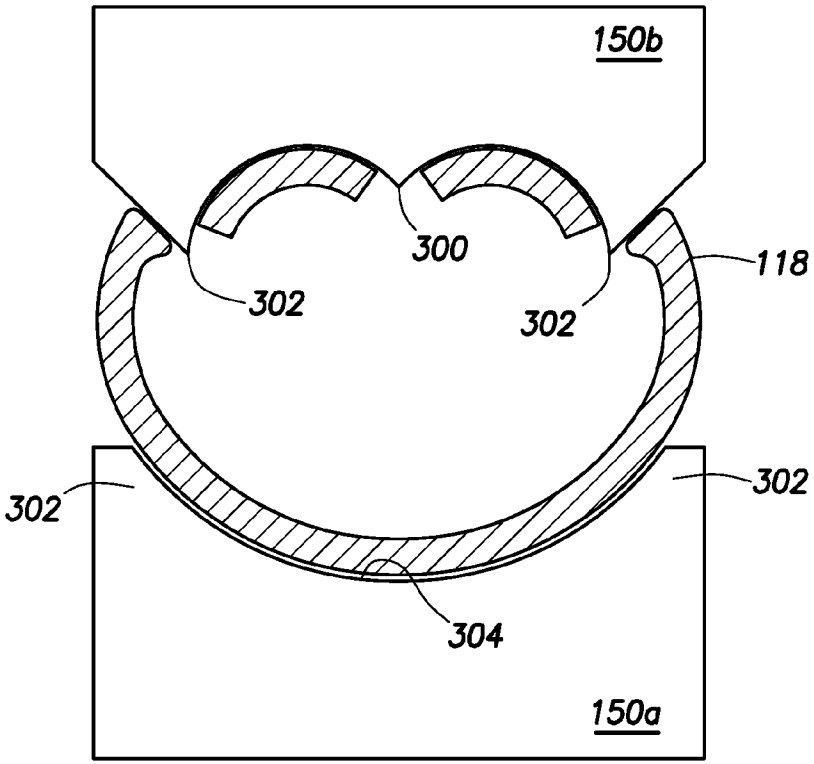
FIGS. 18A and 18B are schematic views, partially in cross-section of a pair of blades engaging a tubular.
Figure 18A:
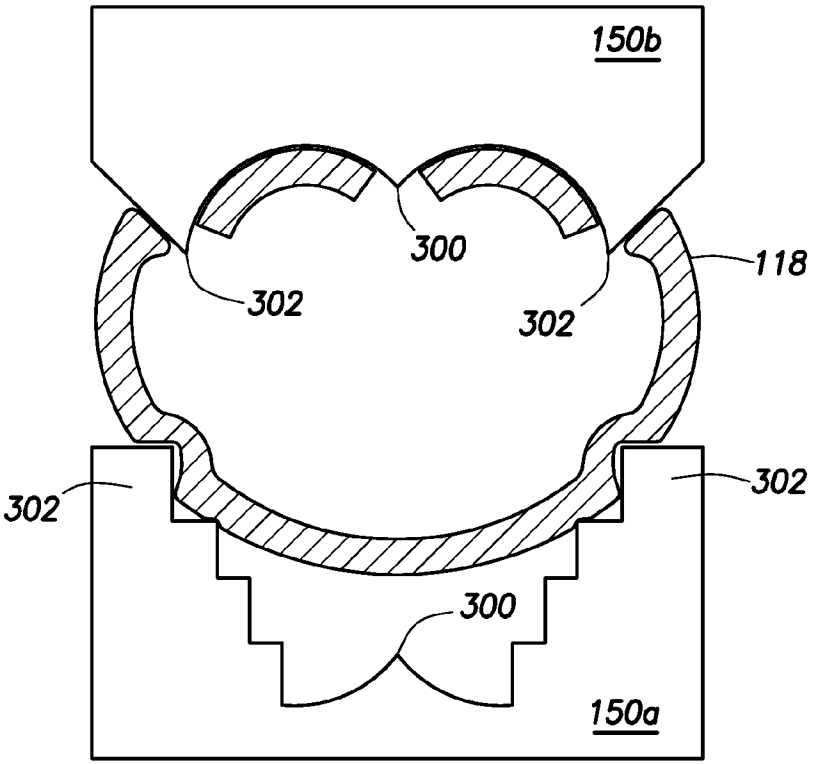

FIGS. 18A-18B show a pair of different blades 150*a,b* engaging the tubular 118 from opposite sides thereof. As shown by these figures, the projections 300 may contact the tubular 118 at various times relative to the shavers 302. As shown in FIG. 18A, the shavers 302 of blade 150*a* contact the tubular 118 before the piercing point 300. The shavers 302 of blade 150*b* contact the tubular 118 simultaneously with the piercing point 300. These figures further depict the piercing action of the piercing point 300 and the shavers 302 as they pierce the tubular. One or more piercing points, projections and/or points may be provided to selectively pierce various parts of the tubular at a desired time. The piercing action of a first blade 150*a* may be selected for cooperation with a piercing action of a second blade 150*b*.

FIG. 18B shows another pair of different blades 150*a,b* engaging the tubular 118. As shown by these figures, a blade 150*b* may be paired with a blade 150*a* having no piercing points, projections and/or points. The blade 150*b* is depicted as the same blade 150*b* of FIG. 17B, but may be any blade. The blade 150*a* has shavers 302 with a single recess 304 therebetween to support the tubular 118 during the severing operation. The recess 304 of blade 150*a* may be configured to align the tubular 118 into a desired position for optimum contact with the blade 150*b*. As also shown in FIG. 18B, the shavers 302 may be positioned for engagement with the tubular 118, or not.

While specific blades are depicted in specific positions about the tubular 118 of FIGS. 17-18B, it will be appreciated that any combination of blades herein may be used and positioned as the upper and/or lower blade 150*a,b*. Additionally, the selected blades may be sized for severing a desired portion of a given tubular.

The upper and lower blades 150 *a,b* may employ the same blades. Alternatively, the blades 150*a,b* may be different. For example, the upper blade 150*a* may have a shape as shown in FIG. 16A and the lower blade 150*b* may have a shape as shown in FIG. 16G, as shown in FIG. 17. In some cases, it may be advantageous to have one blade 150 with a piercing point 300 and the other blade 150*b* to have a recess 304 positioned opposite thereto during operation, as shown in FIG. 18B.

FIGS. 19A-19D depict cross-sectional views of shear areas of the tubular 118 severable by blades 150*a,b*. In a conventional BOP, the shear blades may shear the entire cross section of the tubular 118 at once. The blades 150*a* and 150*b* of FIGS. 19A-D are configured to remove material from the tubular 118 in a multi-phase process. The multi-phase process occurs as the blades 150*a* and 150*b* remove and/or displace sections of the tubular 118 until the tubular 118 is severed. Removing and/or displacing the sections of the tubular 118 at different times and/or using different portions of the blades 150*a* and 150*b* may be used to reduce the force required by the BOP 108 to sever the tubular 118.

FIGS. 19A-19D depict the tubular 118 broken into sections for descriptive purposes. A central (or initial) engagement section 1900 may be a section of the tubular 118 proximate the piercing point 300 of the blades 150*a* and/or 150*b*. For descriptive purposes, blade 150*b* is depicted in hidden line to show operation of the blade 150*a* as it pierces and rakes through tubular 118. The central engagement section (or central portion) 1900 may be the section of the tubular 118 wherein the piercing point 300 engages the tubular 118. A mid engagement section 1902 may be located on either side of the central engagement section 1900. The mid engagement section 1902 may be engaged by the troughs 304. An outer engagement section 1904 (or outer portion) may be located on both sides of the tubular 118 offset from the central engagement section 1900. The outer engagement sections 1904 may be engaged by the troughs 304 and/or shavers 302.

The contact surfaces of the blades 150*a,b* can be defined by the geometry. The blades 150*a,b* may be configured to selectively pass through the tubular 118 to reduce shear forces during the severing process. As shown in FIGS. 19A, 19C and 19D, the troughs 304 may contact the mid and outer engagement sections 1902 and 1904. Additionally, the piercing point 300 may be positioned to engage the central engagement section 1900 before, during or after the troughs 304 and/or shavers 302 contact the tubular 118. The piercing point 300 may be positioned relative to the shavers 302 and the trough 304, such that the outer engagement section 1904 may be engaged before, during or after the mid engagement sections 1902, 1904 are engaged by the troughs 304.

Figure 19B:
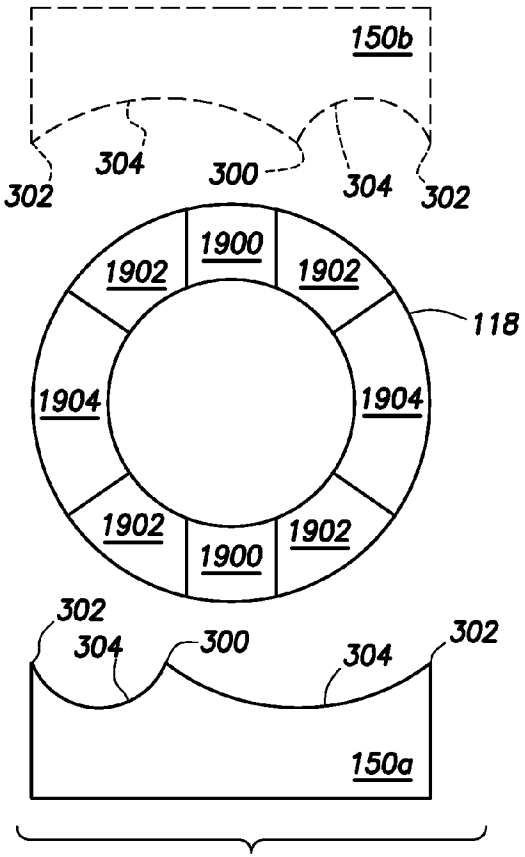
FIGS. 19A-19D are schematic, cross-sectional views of a shear area of a tubular.
Figure 19A:
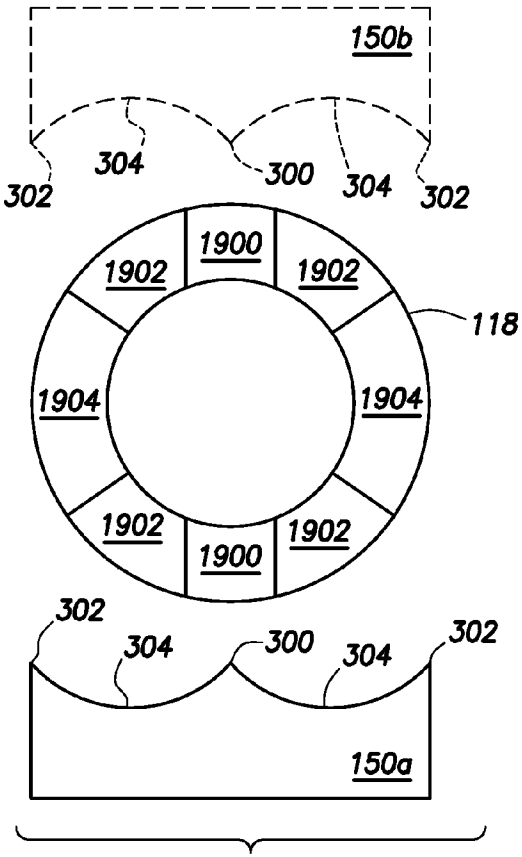
Figure 19D:
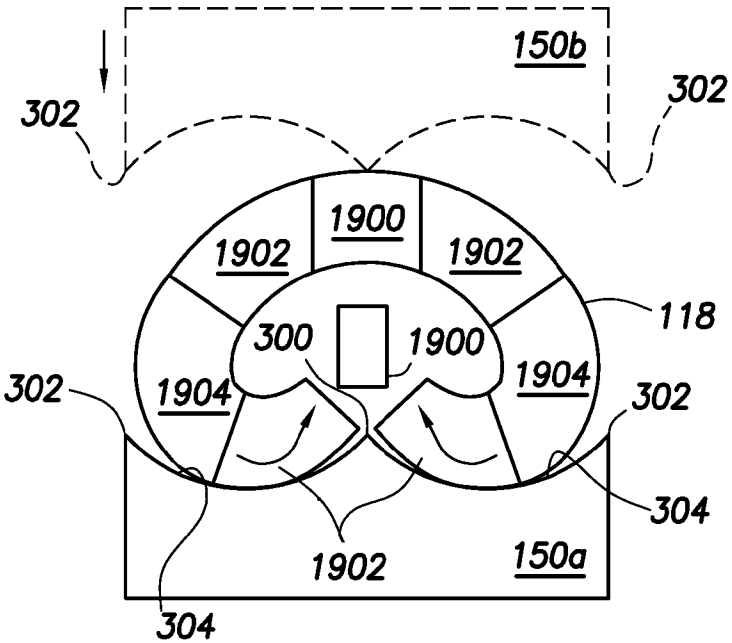
Figure 19C:
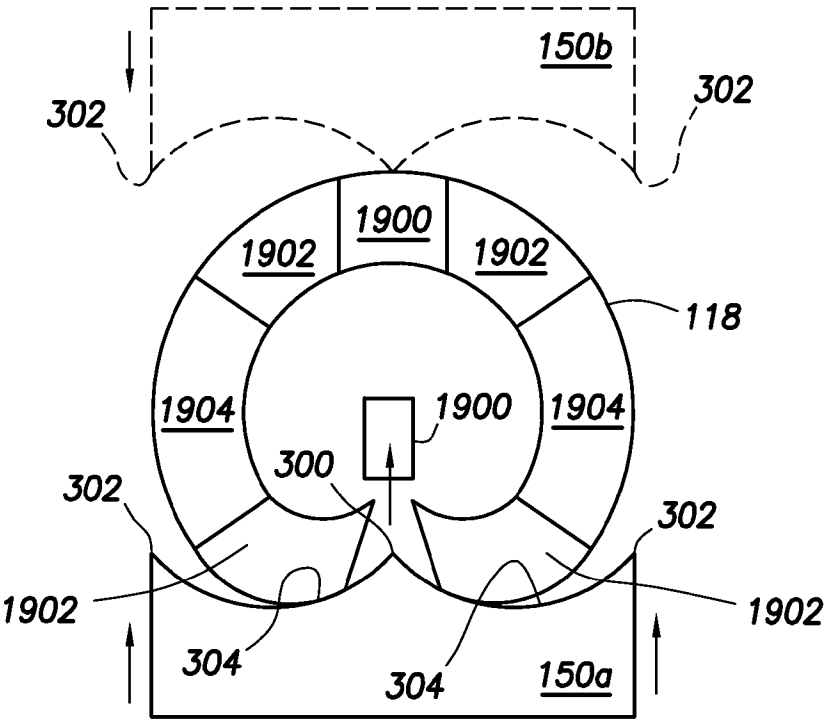

As shown by FIGS. 19A and 19B, the blades 150*a,b* may be located at a position for contacting various portions of the tubular 118. The blade 150*a* of FIG. 19A is positioned to engage central engagement section 1900. As shown in FIG. 19B, the piercing point 300 may be shifted or offset from the central portion of the tubular (or the central engagement section 1900). The piercing point 300, shavers 302 and recesses 304 may be configured to contact desired portions of the tubular to achieve the desired contact locations and sever the tubular 118.

FIGS. 19C and 19D shows the blade 150*a* engaging the tubular 118 and dislodging a portion (or slug) of the tubular at central engagement section 1900. As shown in FIGS. 19A and 19B, blade 150*a* has a piercing point 300. However, it will be appreciated that blade 150*b* may engage the tubular and perform the same piercing, raking and severing function from an opposite side to the blade 150*a* to provide severing from both sides of the tubular 118.

The piercing point 300 of blade 150*a* may be used to pierce the central engagement section 1900. As shown, a chunk of material in section 1900 may be dislodged from the tubing. The blade 150 advances through the tubular 118 and engages the mid engagement sections 1902 along the recesses 304. As the recesses 304 contact the tubular 118, they rake through the tubular 118 and remove material therefrom. The blade 150*a* may continue to advance into the tubular 118 and wedge along the mid and outer engagement sections 1902, 1904 to sever the tubular 118, or until the tubular 118 breaks apart.

Similar or different blades 150*a* and 150*b* may be used to engage the tubular 118 on opposite sides. The opposing blades 150*a,b* may completely sever through the tubular 118 during the operation. The opposing blades 150*a,b* may optionally pierce, rake and/or cut through a portion of the tubular 118 and the remainder may fail and break apart on its own. The tubular 118 may optionally be placed under tension and/or torque during the process to facilitate severing.

Although only certain sections are shown, it should be appreciated that each of the sections may be broken up into smaller sections. Further, any portion of the blades 150*a* and/or 150*b* may be configured to engage the sections 1900, 1902 and/or 1904 as desired. In some cases, as the blades 150*a* and/or 150*b* may engage the tubular 118, the piercing point may pierce and/or remove a portion of the tubular 118 and the shavers 304 may rake through the tubular 118 until the tubular shears either by passing the blades 150*a,b* completely through the tubular 118 or until the tubular fails and separates.

In operation, the piercing point 300 of the blades 150*a* and/or 150*b* may engage the initial engagement section 1900. The troughs 204 of blades 150*a* and/or 150*b* then remove and/or displace remaining portions of the initial engagement section 1900. The troughs 304 of the blades 150*a* and/or 150*b* may then engage the secondary engagement sections 1902. The troughs 304 may then remove and/or displace the mid engagement sections 1902, or portions thereof. As the blades 150*a* and/or 150*b* continue in the cutting direction, the blades 150*a* and/or 150*b* may sever the outer engagement section 1904 of the tubular 118 thereby severing the tubular 118. The blades 150*a* and/or 150*b* may be configured to engage any of the sections herein at different times. For example, the blades 150*a* and/or 150*b* may engage the secondary engagement section 1902 first followed by the initial engagement section 1900 and/or the final engagement section 1904.

Figure 20A:
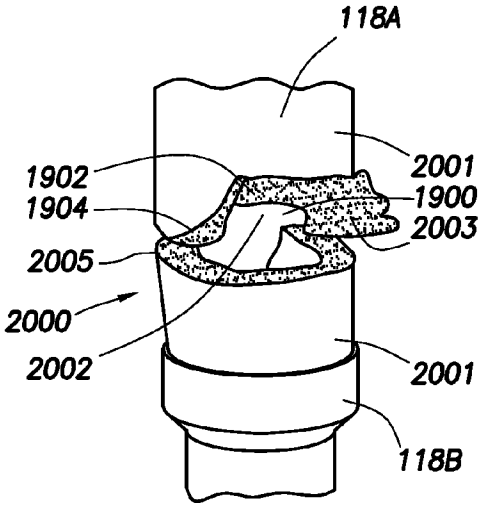
FIGS. 20A-20H are schematic views depicting various portions of a tubular severed by a BOP, and the blade used therewith.
Figure 20B:
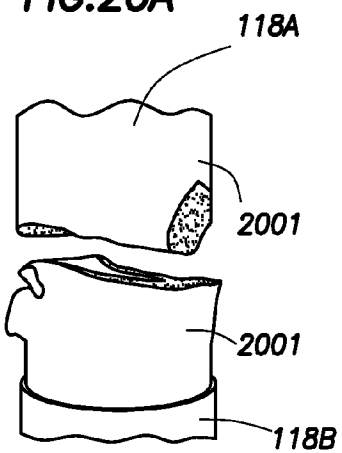
Figure 20D:
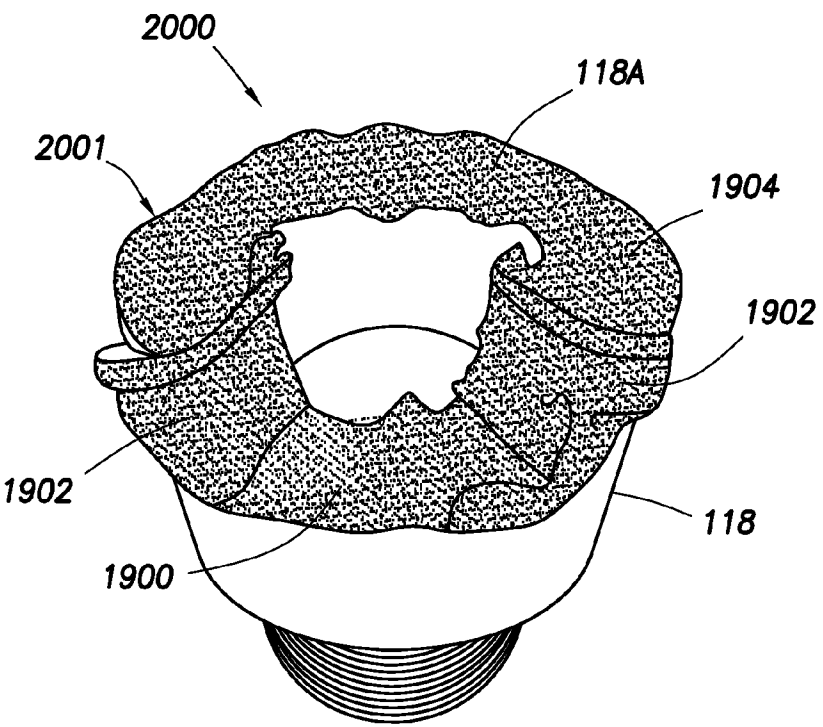
Figure 20C:
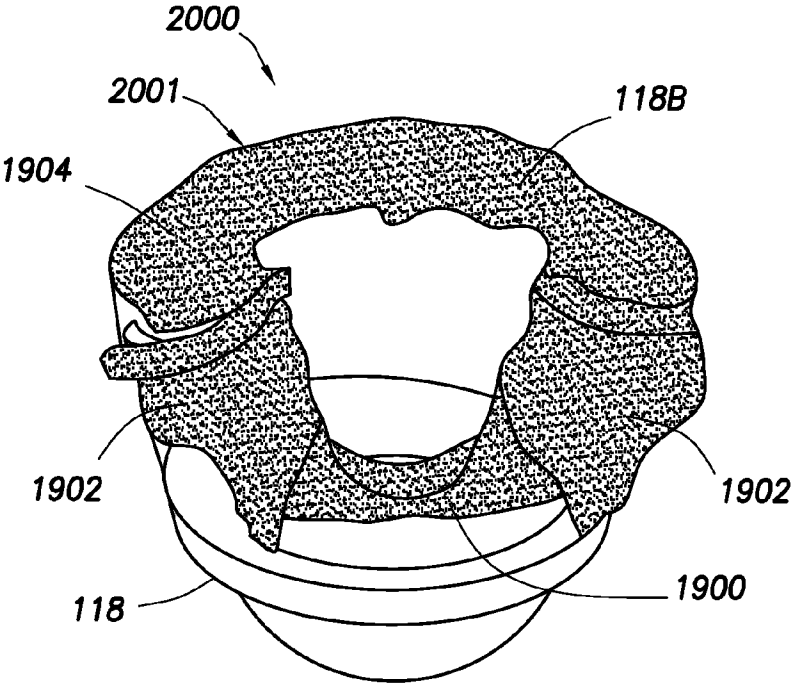
Figure 20F:
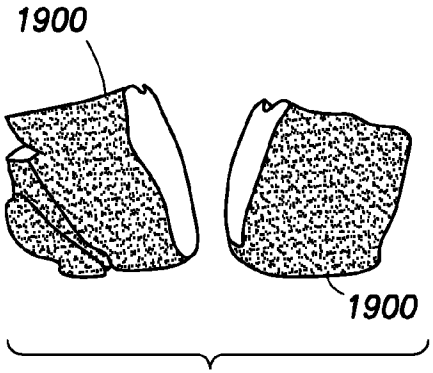
Figure 20E:
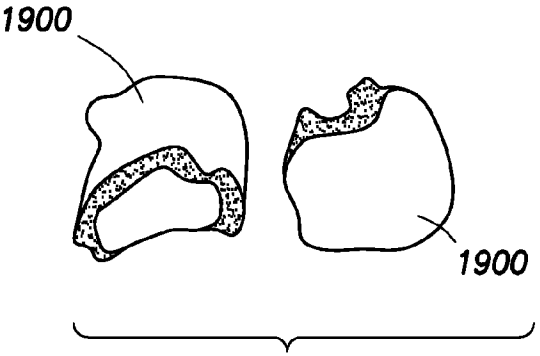
Figure 20H:
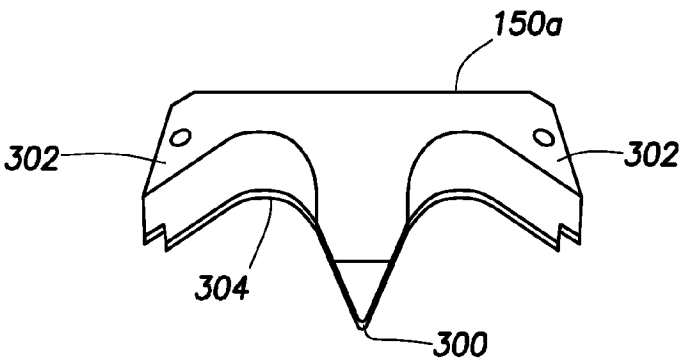
Figure 20G:
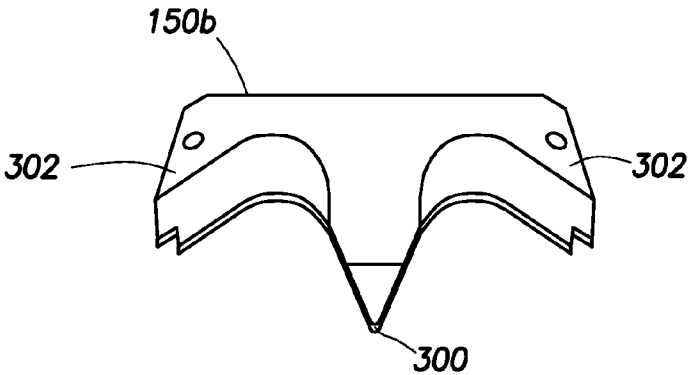

FIGS. 20A-20D depict portions of the tubular 118 of FIG. 19 having a tool joint 2000 that has been engaged and severed by the blades 150*a* and/or 150*b* of, for example, FIGS. 20G and 20H. These figures depict various views of the tubular 118 severed into upper portions 118*a* and lower portions 118*b* as shown in FIG. 2C. For descriptive purposes, FIGS. 20A and 20B show the upper and lower portions 118*a,b* stacked together. FIGS. 20A and 20B separately show the upper and lower portions 118*a,b*, respectively. FIGS. 20E and 20F depict the removed sections and/or portions (or slugs) of the initial engagement sections 1900 after being removed from the tool joint 2000 of FIGS. 20A-20D. Although, the removed initial engagement section 1900 is shown as one removed piece, or slug, it may take any suitable form. For example, the initial engagement section 1900 may be in several pieces, may not detach from the tool joint, may split into two pieces, may be displaced, and the like. FIGS. 20G and 20H depict an example of the blade 150*a* and/or 150*b* used to sever the tool joint 2000. Any of the blades 150 described herein may have been used to sever the tool joint 2000.

In cases where a tubular 118 is particularly thick, for example, having a thickness of 8.5" (21.59 cm) or more or more with a thick wall of greater than about 1" (2.54 cm), such as a tool joint, the shear forces used by the blades may be extremely high. By distributing the forces along the blades using the configurations provided herein, the piercing point 300 may be used to pierce the tubular 118 and remove a slug, such as initial engagement section 1900 as depicted in FIGS. 20E-20F. The cutting surfaces 306 may rake through the tubular 118 to remove pieces of the tubular dislodged by the blade and pass through the remainder of the tubular 118, such as middle engagement section 1902 and/or final engagement section 1904. In cases where the shavers 302 contact the tubular 118, the shavers 302 may also be used to pierce and/or rake through final engagement section 1904 of the tubular 118 as shown in FIGS. 20A-20D. Depending on the geometry selected (see for example the blade profiles of FIGS. 16A-J), the initial points of contact and/or piercing may be varied.

In FIGS. 20A-20D, the tool joint 2000 is shown with its severed tool joint sections 2001 to illustrate the cutting mechanics of the blade 150*a* and/or 150*b* used to sever the tool joint 2000. The initial engagement portion 1900 has been engaged by the piercing point 300 and removed from the tool joint 2000 by the blades 150*a* and/or 150*b*, as shown by an aperture 2002 in the tool joint 2000 of FIGS. 20A-20B. The secondary engagement section 1902 has been partially displaced and/or removed by the recesses 304 of the blades 150*a* and/or 150*b*, as can be seen by a semi-circular wedge 2003 removed from the tool joint 2000. The final engagement section 1904 is engaged by the recesses 304 and/or shavers 302 and may have substantially less material removed from it, and may be a cut line 2005 by severing or by failure of the tubular 118.

Figure 21A:
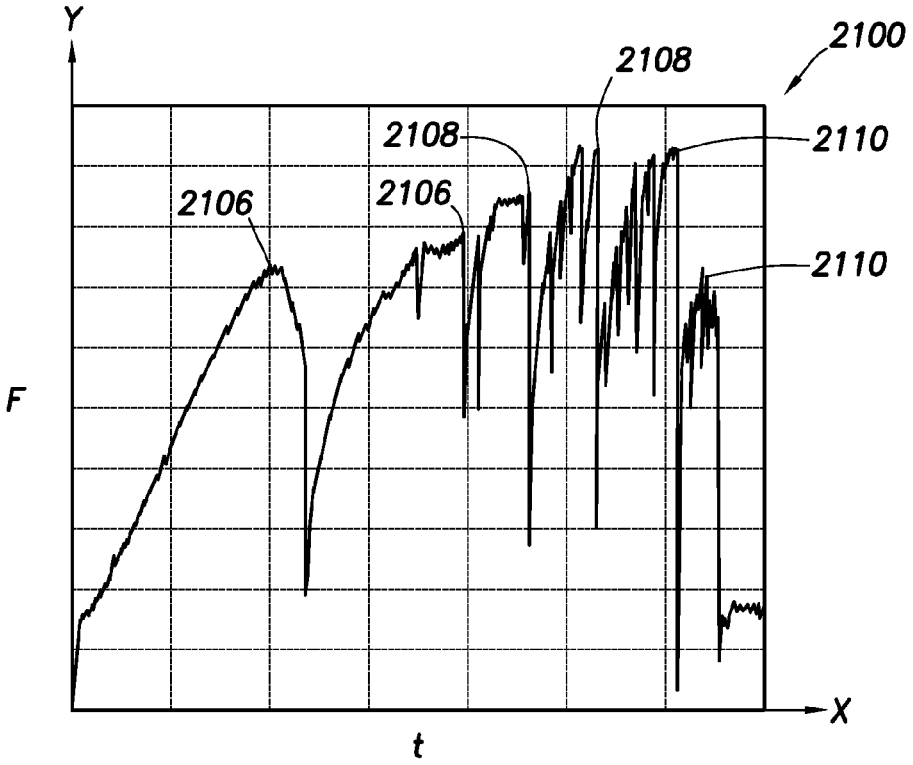
FIGS. 21A-21B are force versus time graphs for a tubular severed by a BOP using various blades.

FIG. 21A depicts a force (F) versus time (t) graph 2100 for tubular 118 severed by, for example, the blades 150*a* and/or 150*b* (as shown in FIG. 1). A force (F) applied to the blades 150*a* and/or 150*b* may be shown on the Y-axis of the graph, and a time (t) for severing using the blades 150*a* and/or 150*b* may be shown on the X-axis of the graph.

The graph 2100 shows that the force F in the blades 150*a* and/or 150*b* increases as time t progresses until the initial piercing (or removal and/or deformation) of the initial engagement section 1900 by blade 150*a* as shown by initial puncture point 2106. After the initial puncture point 2106 is breached (e.g., when initial engagement section 1900 is dislodged as shown in FIG. 19B), the force F in the blades 150*a* and/or 150*b* may drop dramatically with time, until an opposing blade 150*b* engages an opposite initial engagement section 1900. Once the opposing blade 150*b* has dislodged initial engagement section 1900 as shown at point 2106, second engagement section 1902 is engaged by each of the blades 150*a,b* as shown as shown by secondary engagement points 2108. The force F then increases with time t as the blades 150*a* and/or 150*b* may begin to rake through (and/or cut, puncture, and/or shear) the secondary engagement section 1902 (e.g., as shown in FIG. 19C). The force F may then rise and drop as time t progresses as sections of the tubular 118 are removed and/or displaced by the blades 150*a* and/or 150*b*, until the tubular 118 is severed, as shown by sever points 2110.

Figure 21B:
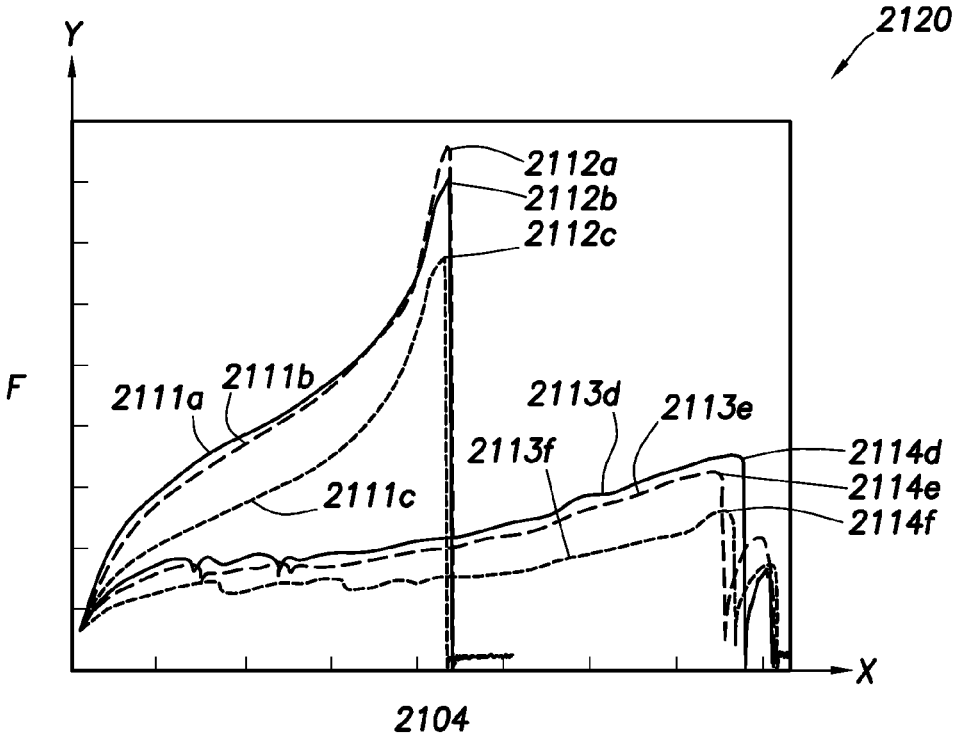

FIG. 21B depicts a force versus time graph 2120 for several thin walled tubulars severed by a conventional shear blade (not shown) compared to the several thin wall tubulars severed by the blades 150*a* and 150*b* of FIG. 2. The conventional shear blades are represented by three conventional shear blade plots 2111*a-c*, respectively, on the force versus time graph 2120. The blades 150*a* and/or 150*b* are represented by three blade plots 2113*d-f*, respectively, on the force versus time graph 2120.

The conventional shear blade as depicted severs the whole shear area of the tubular at once. As can be seen the force F required to sever the thin wall tubular using the conventional shear blades, the force applied to the blades may continually increase with time as the conventional shear blade shears the thin walled tubulars. The force in the conventional shear blades may rise until a peak conventional blade force 2112*a-c*, respectively, is reached and the thin walled tubulars are cut.

The blades 150*a* and/or 150*b* may pierce, rake, cut, shear, displace, and/or remove sections of the tubular independent of one another. As can be seen the force required to sever the thin walled tubulars by the blades 150*a* and/or 150*b*, the force of the blades 150*a* and/or 150*b* may rise and fall until a peak blade force 2114*d-f* is reached and the thin walled tubular is severed. Therefore, the force required to sever the tubular 118 with the conventional shear blade may be much greater than the force F required to sever the tubular 118 with the blades 150*a* and/or 150*b*. Further, the conventional shear blades may be unable to shear large thick walled tubular and/or tool joints 2000.

Figure 22A:
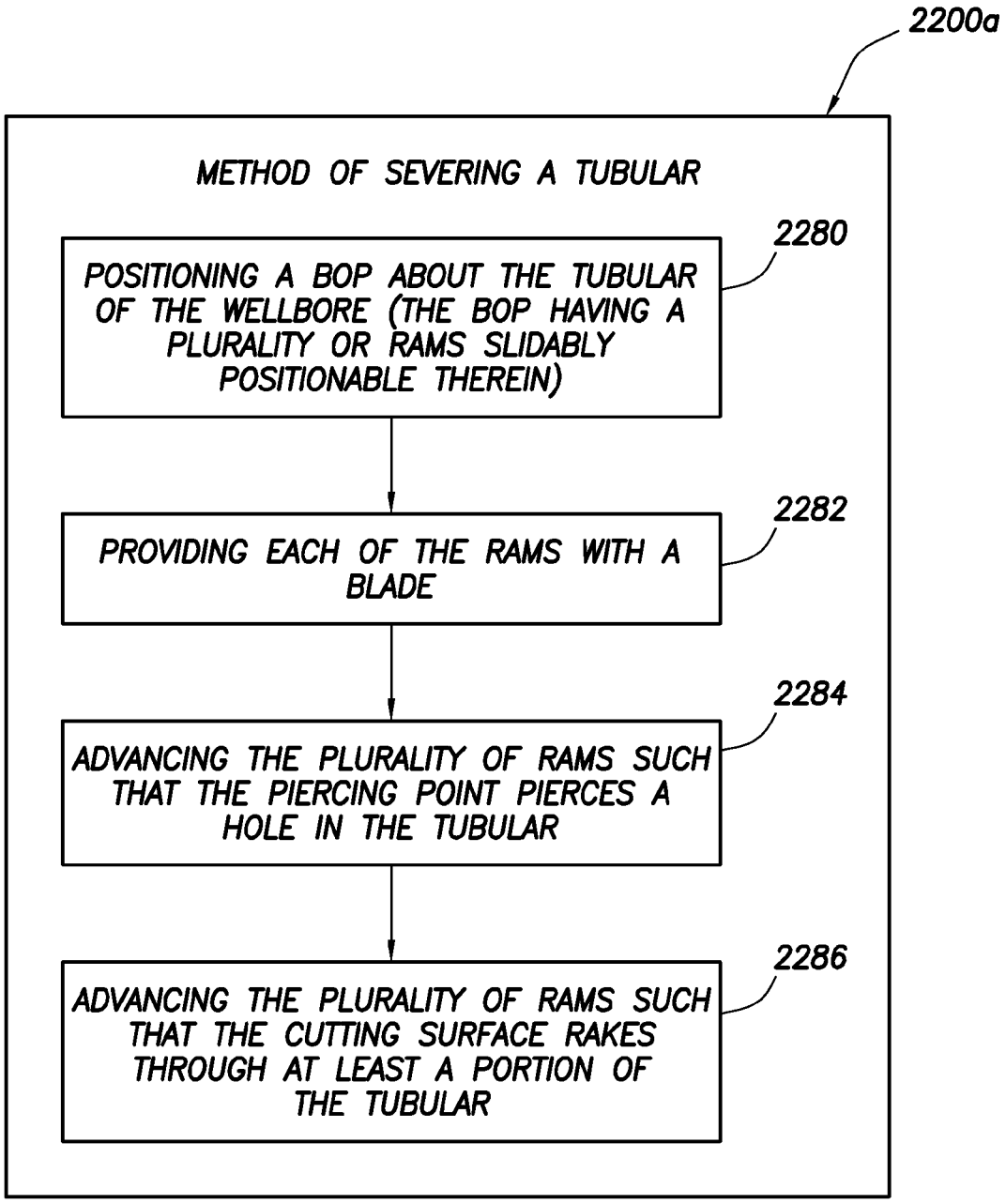
FIGS. 22A and 22B are flow charts depicting methods of severing a tubular.
Figure 22B:
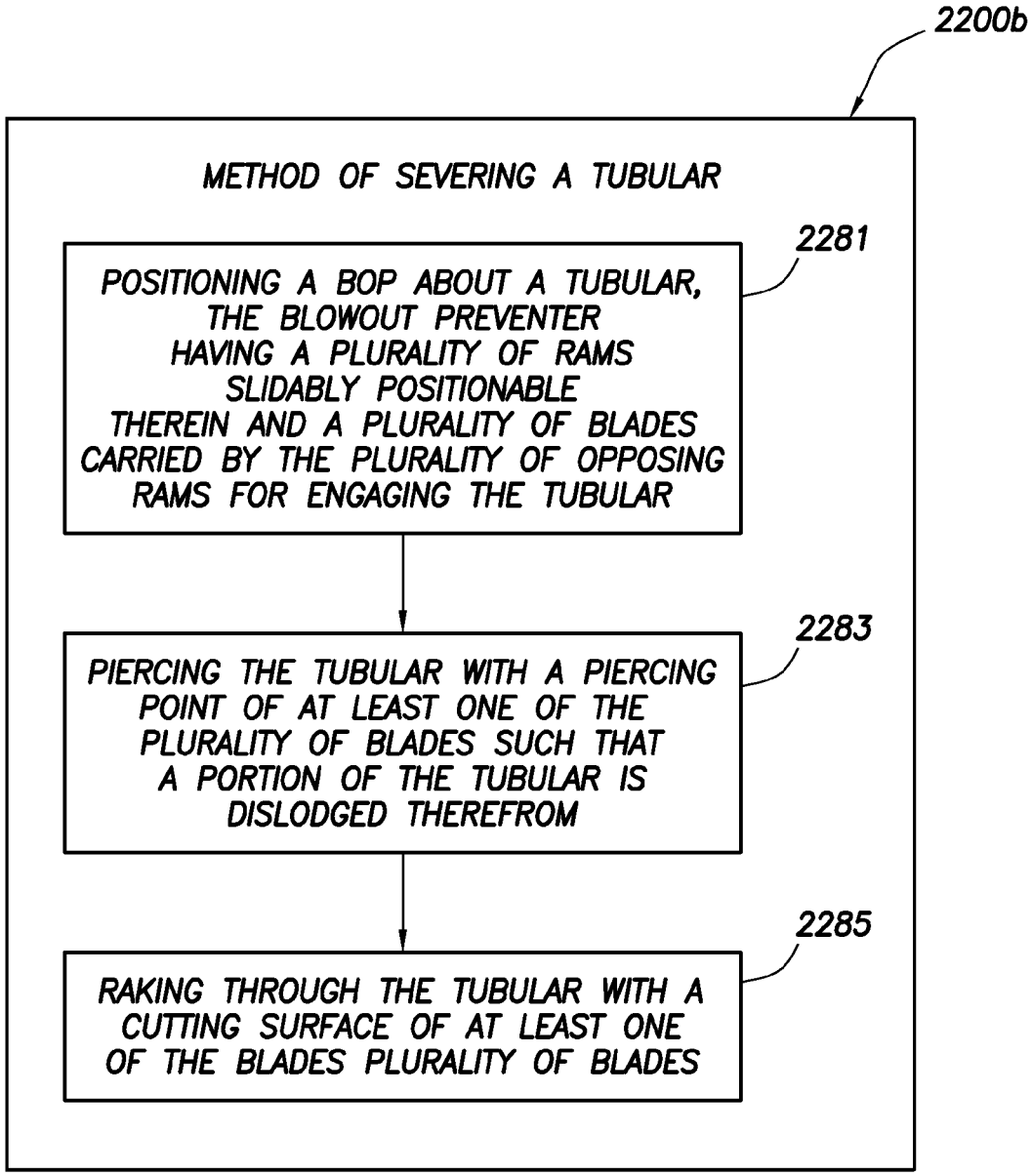

FIGS. 22A and 22B depict methods 2200*a* and 2200*b* of severing a tubular. The method 2200*a* involves positioning (2280) a BOP about the tubular of the wellbore (the BOP having a plurality of rams slidably positionable therein), providing (2282) each of the rams with a blade, piercing (2284) a hole in the tubular with a tip of the piercing point of the blade, and raking (2286) through the pierced tubular with the cutting surface of the blade.

The method 2200*b* involves positioning (2281) a BOP about the tubular of the wellbore, the BOP having a plurality of rams slidably positionable therein (the blowout preventer having a plurality of opposing rams slidably positionable therein and a plurality of blades carried by the plurality of opposing rams for engaging the tubular), piercing (2283) the tubular with a piercing point of at least one of the blades such that a portion of the tubular is dislodged therefrom, and raking (2285) through the tubular with a cutting surface of at least one of the blades to displace material of the tubular.

The raking of either method may be performed using the cutting surfaces and/or shavers. The cutting surfaces may also be used to pierce a hole in the tubular. Steps of either method may be used together, repeated and/or performed in any order.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, any of the blades shown herein, may be used in combination with other shaped blades herein, and/or conventional blades. Further, any of the blades may have the replaceable tips 400. The piercing point 300 may extend beyond the blade cutting surfaces, or be recessed therebehind. The piercing points 300 may be rounded or pointed. The recesses may be rounded, squared or other geometries.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A method for severing a tubular of a wellbore, the wellbore penetrating a subterranean formation, the method comprising:

positioning a blowout preventer with the tubular therethrough, the blowout preventer having a plurality of rams slidably positionable therein and a plurality of blades carried by the plurality of rams for engaging the tubular;

piercing the tubular with a piercing point of at least one of the plurality of blades such that a portion of the tubular is detached therefrom; and raking through the tubular with a cutting surface of at least one of the plurality of blades.

2. The method of claim 1, further comprising continuing to advance the plurality of rams until the tubular is severed.

3. The method of claim 1, wherein in the step of raking, the cutting surface is advanced until the tubular shears apart.

4. The method of claim 1, wherein in the step of piercing, the piercing point pierces a central engagement portion of the tubular.

5. The method of claim 1, wherein in the step of piercing, the piercing point pierces a mid engagement portion of the tubular.

6. The method of claim 1, wherein in the step of raking, the cutting surface passes through a mid engagement portion of the tubular.

7. The method of claim 1, wherein in the step of raking, the cutting surface passes through an outer engagement portion of the tubular.

8. The method of claim 1, wherein the plurality of blades further comprises a pair of shavers, the method further comprising passing at least one of the pair of shavers through at least a portion of the tubular.

9. The method of claim 8, wherein in the step of passing, the at least one of the pair of shavers passes through an outer engagement portion of the tubular.

10. The method of claim 1, wherein the plurality of blades comprises an upper blade and a lower blade, the method further comprising passing the upper blade through the tubular above the lower blade.

11. The method of claim 1, wherein the tubular is a tool joint.

12. A method for severing a tubular of a wellbore, the wellbore penetrating a subterranean formation, the method comprising:

positioning a blowout preventer with the tubular therethrough, the blowout preventer comprising a plurality of rams slidably positionable therein, each of the plurality of rams carrying a blade, each of the blades comprising:

a blade body having a front face on a side thereof facing the tubular, the blade body comprising:

a cutting surface along at least a portion of the front face; and a piercing point along the front face, the piercing point having a tip extending a distance beyond the cutting surface;

piercing the tubular with the piercing point of the blade such that a portion of the tubular is detached therefrom; and raking through the tubular with the cutting surface of the blade.

13. The method of claim 12, wherein in the step of raking, the cutting surface is advanced until the cutting surface severs the tubular.

14. The method of claim 12, wherein in the step of raking, the cutting surface is advanced until the tubular shears apart.

15. The method of claim 12, wherein in the step of piercing, the piercing point pierces a central engagement portion of the tubular.

16. The method of claim 12, wherein in the step of raking, the cutting surface passes through a mid engagement portion of the tubular.

17. The method of claim 12, wherein in the step of raking, the cutting surface passes through an outer engagement portion of the tubular.

18. The method of claim 12, wherein the blade body further comprises a pair of shavers along the front face of the blade body, each of the pair of shavers on either side of the tip, the method further comprising passing at least one of the pair of shavers through at least a portion of the tubular.

19. The method of claim 18, wherein the at least one of the pair of shavers passes through an outer engagement portion of the tubular.

20. The method of claim 12, wherein the tubular is a tool joint.

21. A method for severing a tubular of a wellbore, the wellbore penetrating a subterranean formation, the method comprising:

positioning a blowout preventer with the tubular therethrough, the blowout preventer having a plurality of rams slidably positionable therein and a plurality of blades carried by the plurality of rams for engaging the tubular; and advancing the plurality of blades through the tubular by piercing the tubular with a piercing point of at least one of the plurality of blades such that a portion of the tubular is detached therefrom and raking through the tubular with a cutting surface of at least one of the plurality of blades until the tubular is severed.

22. The method of claim 21, wherein the plurality of blades further comprises a pair of shavers, the step of advancing further comprising passing at least one of the pair of shavers through at least a portion of the tubular.

23. The method of claim 22, wherein the step of advancing further comprises advancing the plurality of blades through the tubular by piercing the tubular with the pair of shavers.

24. The method of claim 21, wherein the plurality of blades comprises an upper blade and a lower blade, the upper blade passing through the tubular a distance above the lower blade.

25. The method of claim 21, wherein the tubular is a tool joint.

* * * * *